US011756483B2

(12) United States Patent
Gao et al.

(10) Patent No.: US 11,756,483 B2
(45) Date of Patent: Sep. 12, 2023

(54) DISPLAY APPARATUS AND METHOD FOR DRIVING THE SAME

(71) Applicants: WUHAN TIANMA MICROELECTRONICS CO., LTD., Wuhan (CN); Wuhan Tianma Microelectronics Co., Ltd. Shanghai Branch, Shanghai (CN)

(72) Inventors: Yana Gao, Wuhan (CN); Xingyao Zhou, Wuhan (CN)

(73) Assignees: WUHAN TIANMA MICROELECTRONICS CO., LTD., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 17/930,466

(22) Filed: Sep. 8, 2022

(65) Prior Publication Data

US 2023/0005426 A1 Jan. 5, 2023

(30) Foreign Application Priority Data

May 26, 2022 (CN) ..... 202210588045.X

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01); *G09G 2320/0233* (2013.01); *G09G 2330/021* (2013.01)

(58) Field of Classification Search
CPC ..... G09G 3/3233; G09G 2300/0842; G09G 2310/08; G09G 2320/0233; G09G 2330/021
See application file for complete search history.

(56) References Cited

U.S. PATENT DOCUMENTS

2006/0022305 A1* 2/2006 Yamashita ..... G09G 3/2014 257/565
2006/0221015 A1* 10/2006 Shirasaki ..... G09G 3/325 345/77
2021/0375201 A1* 12/2021 Park ..... G09G 3/3233

FOREIGN PATENT DOCUMENTS

CN 112086062 A 12/2020
CN 112785956 A 5/2021

* cited by examiner

*Primary Examiner* — Stephen G Sherman
(74) *Attorney, Agent, or Firm* — CHRISTENSEN O'CONNOR JOHNSON KINDNESS PLLC

(57) ABSTRACT

A display apparatus and a method for driving the same are provided. The display apparatus includes pixel circuits and a threshold detection module. The pixel circuit includes a driving transistor and a data voltage writing module including an output terminal electrically connected to the driving transistor. The threshold detection module is configured to detect a threshold voltage of the driving transistor. An operating process of the pixel circuit includes a first phase and a second phase. The first phase includes a data writing phase and a light-emitting phase. The second phase includes an adjusting phase and a light-emitting phase. The driving transistor receives a data voltage during the data writing phase. During the adjusting phase, the driving transistor receives an adjusting voltage corresponding to the threshold voltage of the driving transistor that is detected by the threshold detection module.

19 Claims, 16 Drawing Sheets

DISPLAY APPARATUS AND METHOD FOR DRIVING THE SAME

CROSS-REFERENCE TO RELATED APPLICATION

The present application claims priority to Chinese Patent Disclosure No. 202210588045.X, filed on May 26, 2022, the content of which is incorporated herein by reference in its entirety.

TECHNICAL FIELD

The present disclosure relates to the field of display technologies, and, particularly, relates to a display apparatus and a method for driving the display apparatus.

BACKGROUND

An organic light-emitting diode (OLED) display apparatus is widely used in the market due to its advantages such as low power consumption, self-luminescence, wide viewing angle, wide temperature characteristics, and fast response speed. A pixel circuit for controlling a light-emitting element to emit light is a core element of the OLED display apparatus, and also has a research value.

In the pixel circuit in the related art, due to operating characteristics of a driving transistor, the display apparatus has different brightness between a first phase and a second phase, thereby affecting the display effect. Especially in a low-gray-scale and low-frequency display state of the display apparatus, the brightness difference between the first phase and the second phase is obvious. The first phase refers to a phase including a data writing phase and a light-emitting phase. The second phase is a phase that is performed after the first phase, and does not include the data writing phase but includes the light-emitting phase.

SUMMARY

A first aspect of the present disclosure provides a display apparatus. The display apparatus includes pixel circuits and a threshold detection module. The pixel circuits include a driving transistor configured to generate a light-emitting driving current, and a data voltage writing module having an output terminal that is electrically connected to the driving transistor. The threshold detection module is configured to detect a threshold voltage of the driving transistor. An operating process of the pixel circuit includes a first phase and a second phase subsequent to the first phase. The first phase includes a data writing phase and a light-emitting phase subsequent to the data writing phase. The second phase includes an adjusting phase and a light-emitting phase subsequent to the adjusting phase. The data voltage writing module is configured to transmit a data voltage to the driving transistor during the data writing phase. The data voltage writing module is configured to transmit an adjusting voltage to the driving transistor during the adjusting phase. The adjusting voltage corresponds to the threshold voltage of the driving transistor detected by the threshold detection module.

A second aspect of the present disclosure provides a method for driving the above display apparatus. The method includes: transmitting, by the data voltage writing module, a data voltage to the driving transistor during the data writing phase; and transmitting, by the data voltage writing module, the adjusting voltage corresponding to the threshold voltage of the driving transistor to the driving transistor during the adjusting phase.

BRIEF DESCRIPTION OF DRAWINGS

In order to more clearly illustrate technical solutions of embodiments of the present disclosure, the accompanying drawings used in some embodiments are briefly described below. The drawings described below are merely some embodiments of the present disclosure. Based on these drawings, those skilled in the art can obtain other drawings.

DESCRIPTION OF EMBODIMENTS

In order to better understand technical solutions of the present disclosure, some embodiments of the present disclosure are described in detail with reference to the drawings.

It should be clear that the described embodiments are merely some of some embodiments of the present disclosure rather than all embodiments. All other embodiments obtained by those skilled in the art shall fall into the scope of the present disclosure.

The terms used in some embodiments of the present disclosure are merely for the purpose of describing specific embodiment, rather than limiting the present disclosure. The terms "a", "an", "the" and "the" in a singular form in some embodiments of the present disclosure and the attached claims are also intended to include plural forms thereof, unless noted otherwise.

It should be understood that the term "and/or" used in the context of the present disclosure is to describe a correlation relation of related objects, indicating that there can be three relations, e.g., A and/or B can indicate A alone, A and B, and B alone. The symbol "/" in the context generally indicates that the relation between the objects before and after "/" is an "or" relationship.

In the description of this specification, it should be understood that words such as "substantially", "approximately", "roughly", and "about" described in the claims and embodiments of the present disclosure indicates that a value is within reasonable technological operating ranges or tolerances, which can be generally acceptable, rather than a precise value.

It should be understood that although the terms first, second, third, etc. can be used in some embodiments of the present disclosure to describe phases, switches, signal lines, etc., these phases, switches, signal lines, etc. should not be limited to these terms. These terms are only configured to distinguish phases, switches, signal lines, etc. from one another. For example, without departing from the scope of some embodiments of the present disclosure, the first switch can also be referred to as the second switch, and similarly, the second switch can also be referred to as the first switch.

Figure 1:
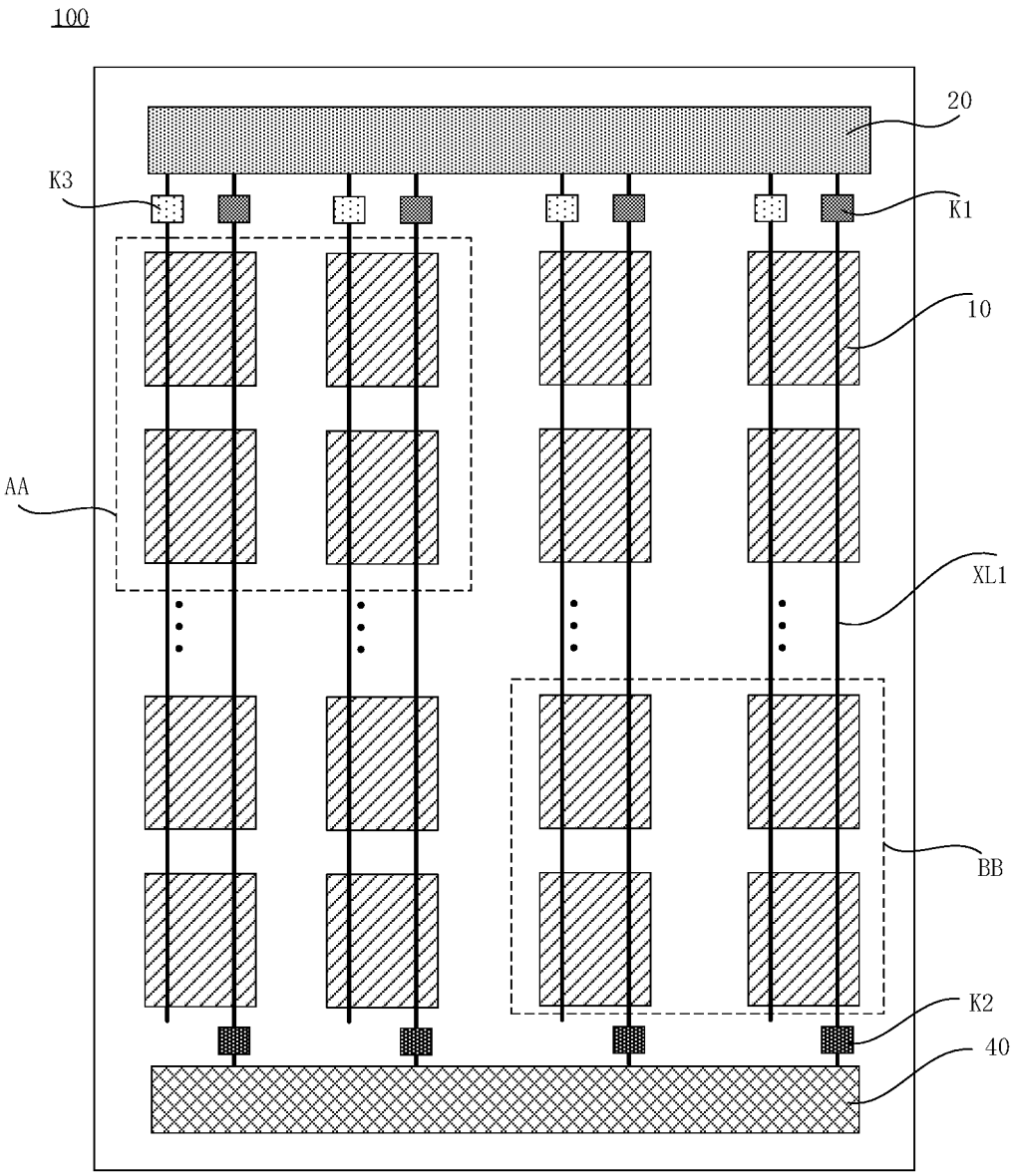
FIG. 1 is a schematic diagram of a display apparatus according to some embodiments of the present disclosure.
Figure 2:
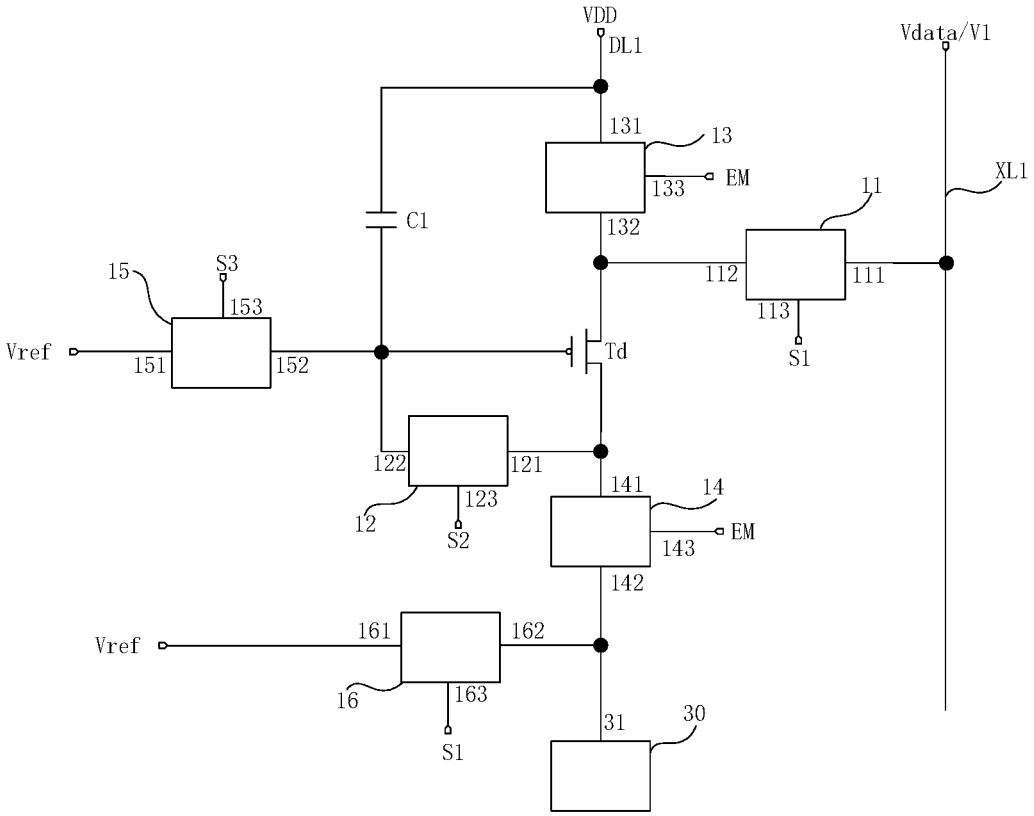
FIG. 2 is a schematic diagram of a pixel circuit according to some embodiments of the present disclosure.
Figure 3:
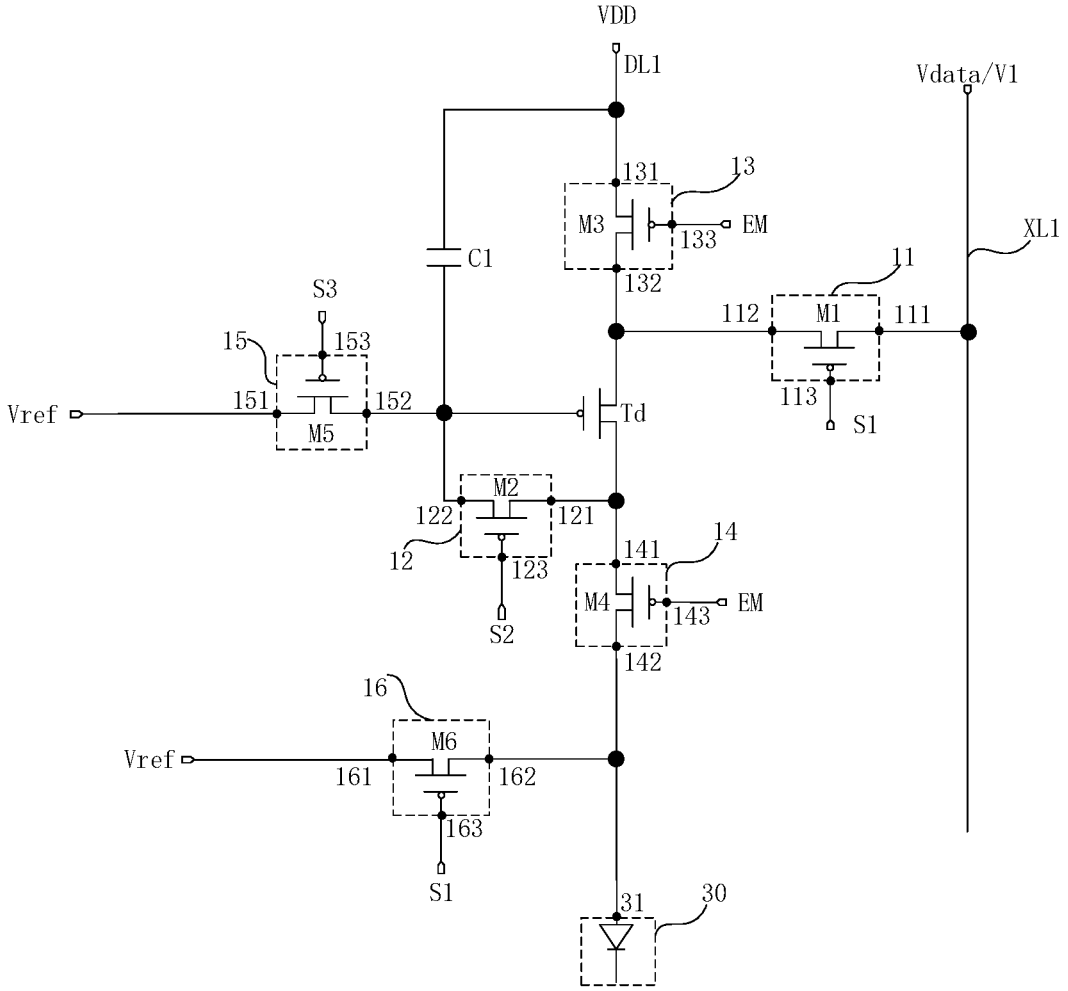
FIG. 3 is a schematic diagram of the pixel circuit shown in FIG. 2 according to some embodiments of the present disclosure.
Figure 4:
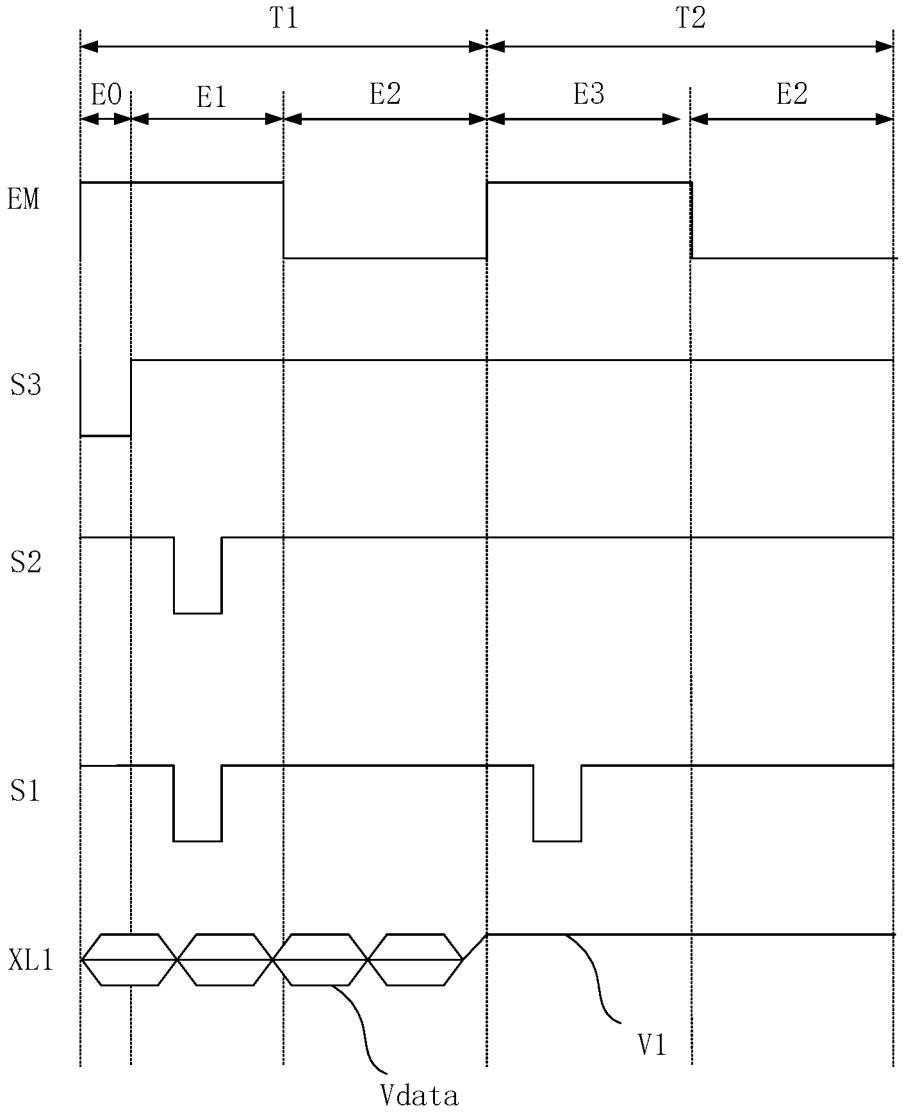
FIG. 4 is a timing sequence of the pixel circuit shown in FIG. 3 according to some embodiments of the present disclosure.

FIG. 1 is a schematic diagram of a display apparatus according to some embodiments of the present disclosure, FIG. 2 is a schematic diagram of a pixel circuit according to some embodiments of the present disclosure, FIG. 3 is a schematic diagram of the pixel circuit shown in FIG. 2 according to some embodiments of the present disclosure, and FIG. 4 is a timing sequence of the pixel circuit shown in FIG. 3 according to some embodiments of the present disclosure.

A first aspect of the present disclosure provides a display apparatus 100. With reference to FIG. 1 through FIG. 4, the display apparatus 100 includes multiple pixel circuits 10 and a threshold detection module 20. The pixel circuit 10 is configured to drive a light-emitting element 30 to emit light, and can be arranged in a display region of the display apparatus 100.

As shown in FIG. 2, the pixel circuit 10 includes a driving transistor Td and a data voltage writing module 11. The driving transistor Td is configured to generate a light-emitting driving current. An output terminal 112 of the data voltage writing module 11 is electrically connected to the driving transistor Td and is configured to transmit a signal, received by data voltage writing module 11, to the driving transistor Td. The threshold detection module 20 is configured to detect a threshold voltage Vth of the driving transistor Td of the pixel circuit 10.

As shown in FIG. 4, an operating process of the pixel circuit 10 includes a first phase T1 and a second phase T2 performed after the first phase T1. The first phase T1 includes a data writing phase E1 and a light-emitting phase E2 performed after the data writing phase E1. The second phase T2 includes an adjusting phase E3 and a light-emitting phase E2 performed after the adjusting phase E3.

The data voltage writing module 11 transmits a data voltage Vdata to the driving transistor Td during the data writing phase E1. The data voltage writing module 11 transmits the adjusting voltage V1 to the driving transistor Td during the adjusting phase E3. The adjusting voltage V1 corresponds to a threshold voltage Vth of the driving transistor Td detected by the threshold detection module 20.

That is to say, the adjusting voltage V1 transmitted by the data voltage writing module 11 corresponds to the threshold voltage Vth of the driving transistor Td that receives the adjusting voltage V1, and the adjusting voltages V1 received by the driving transistors can be different when the threshold voltages Vth of the driving transistors Td are different from each other.

During the adjusting phase E3, the data voltage writing module 11 transmits the adjusting voltage V1 to a source or a drain of the driving transistor Td.

In some embodiments, as shown in FIG. 2 through FIG. 4, a control terminal 113 of the data voltage writing module 11 is electrically connected to a first scanning line S1, and a signal transmitted by the first scanning line S1 controls turn-on and turn-off states of the data voltage writing module 11.

During the data writing phase E1, the first scanning line S1 transmits an effective signal to control the data voltage writing module 11 to be turned on, and at the same time, the data voltage writing module 11 receives the data voltage Vdata, and the data voltage Vdata is transmitted to the driving transistor Td through the turned-on data voltage writing module 11.

During the adjusting phase E3, the first scanning line S1 transmits an effective signal to control the data voltage writing module 11 to be turned on, and at the same time, the data voltage writing module 11 receives the adjusting voltage V1, and the adjusting voltage V1 is transmitted to the driving transistor Td through the turned-on data voltage writing module 11, and the adjusting voltage V1 corresponds to the threshold voltage Vth of the driving transistor Td that receives the adjusting voltage V1 and that is detected by the threshold detection module 20.

In the related art, during a first phase T1 during which the display apparatus 100 displays a frame of an image, in order to make the driving transistor Td generate a required light-emitting driving current, a gate of the driving transistor Td needs to be reset, and then the data voltage Vdata can be written to the gate of the driving transistor Td. This process can ensure that, during the light-emitting phase E2 of the first phase T1, a required light-emitting driving current can be generated by the driving transistor Td and then is transmitted to the light-emitting element 30. The initial phase of the light-emitting element 30 during which the light-emitting element 30 emits light includes a current ramping process, and a speed of the current ramping is related to the bias state of the driving transistor Td.

However, during a second phase T2 during which the display apparatus 100 of the related art displays the same frame of the image, the gate of the driving transistor Td is no longer reset and the data voltage Vdata is no longer written to the gate of the driving transistor Td, and the gate of the driving transistor Td remains at a substantially same potential as the potential of the gate of the driving transistor Td that is kept during a prior phase, and the driving transistor Td transmits the light-emitting element 30 after the light-emitting driving current is generated. In this way, a large difference in the bias state of the driving transistor Td at the beginning of a light-emitting phase E2 of the second phase T2 and at the beginning of a light-emitting phase E2 of the first phase T1 is formed, which results in a significant difference in the ramping speed of the light-emitting driving current transmitted to the light-emitting element 30 during the first phase T1 and the second phase T2, and thus results in a significant difference in the brightness of the display apparatus 100 during the first phase T1 and the second phase T2, thereby affecting a normal display of the display apparatus, for example, an obvious flickering problem at a low-frequency and low-grayscale display state of the display apparatus.

In some embodiments of the present disclosure, during the adjusting phase E3 of the second phase T2, the data voltage writing module 11 transmits the adjusting voltage V1 to the driving transistor Td, so that the bias state of the driving transistor Td can be corrected, and the difference in the bias state the driving transistor Td during the second phase T2 and the first phase T1 can be reduced. In this way, the difference in the ramping speed of the light-emitting driving current transmitted to the light-emitting element 30 during the first phase T1 and the second phase T2 is reduced, thereby reducing the brightness difference of the display apparatus 100 during the first phase T1 and the second phase T2, and improving the display effect of the display apparatus 100.

Since different driving transistors Td can have different characteristics, the characteristics of a same driving transistor Td will also change with time, so that during different first phases T1, the driving transistor Td of the pixel circuit 10 can have a same bias state or different bias states. The different first phases T1 can be the first phases of a same pixel circuit 10 during different frames of the image, or can be the first phases of different pixel circuits 10 during a same frame of the image.

Since the threshold voltage Vth of the driving transistor Td is the main parameter describing the characteristics of the driving transistor Td, in some embodiments of the present disclosure, the adjusting voltage V1 transmitted by the data voltage writing module 11 to the driving transistor Td during the adjusting phase E3 corresponds to the threshold voltage Vth of the driving transistor Td, so that the adjusting voltage V1 received by the driving transistor Td can vary with the characteristics of the driving transistor Td, thereby minimizing the bias state difference of the driving transistor Td during the second phase T2 and the first phase T1 of a same frame of the image, and thus improving the display effect of the display apparatus 100.

In some embodiments of the present disclosure, as shown in FIG. 2 and FIG. 3, the pixel circuit 10 can include a threshold-voltage capturing module 12, a power supply voltage writing module 13, a light-emitting control module 14, a first reset module 15, a second reset modules 16, and a first capacitor C1. An output terminal 112 of the data voltage writing module 11 is electrically connected to the source of the driving transistor Td. The threshold-voltage capturing module 12 includes an input terminal 121 electrically connected to the drain of the driving transistor Td, an output terminal 122 electrically connected to the gate of the driving transistor Td, and a control terminal electrically connected to a second scanning line S2. The power supply voltage writing module 13 includes an input terminal 131 electrically connected to a power supply voltage signal line DL1, an output terminal 132 electrically connected to the source of the driving transistor Td, and a control terminal 133 electrically connected to a light-emitting control signal line EM. The light-emitting control module 14 includes an input terminal 141 electrically connected to the drain of the driving transistor Td, an output terminal 142 electrically connected to the light-emitting element 30, and a control terminal 143 electrically connected to the light-emitting control signal line EM. A signal transmitted by the light-emitting control signal line EM controls the power supply voltage writing module 13 and the light-emitting control module 14 to have a same turn-on/off state. The first reset module 15 includes an input terminal 151 configured to receive a reset voltage Vref, an output terminal 152 electrically connected to the gate of the driving transistor Td, and a control terminal 153 electrically connected to a third scanning line S3. The first reset module 15 is configured to reset the gate of the driving transistor Td. The second reset module 16 includes an input terminal 161 configured to receive the reset voltage Vref, an output terminal 162 electrically connected to an input terminal 31 of the light-emitting element 30, and a control terminal 163 electrically connected to the first scanning line S1. The second reset module 16 is configured to reset the input terminal 31 of the light-emitting element 30, and a signal transmitted by the first scanning line S1 controls the data voltage writing module 11 and the second reset module 16 to have a same turn-on/off state. The first capacitor C1 includes an electrode plate electrically connected to the power supply voltage signal line DL1, and another electrode plate electrically connected to the gate of the driving transistor Td.

In some embodiments, the data voltage writing module 11 includes a first transistor M1, and the first transistor M1 includes a source electrically connected to the input terminal 111 of the data voltage writing module 11, a drain electrically connected to the output terminal 112 of the data voltage writing module 11, and a gate electrically connected to the control terminal 113 of the data voltage writing module 11. The threshold-voltage capturing module 12 includes a second transistor M2, and the second transistor M2 includes a source electrically connected to the input terminal 121 of the threshold-voltage capturing module 12, a drain electrically connected to the output terminal 122 of the threshold-voltage capturing module 12, and a gate electrically connected to the control terminal 123 of the threshold-voltage capturing module 12. The power supply voltage writing module 13 includes a third transistor M3, and the third transistor M3 includes a source electrically connected to the input terminal 131 of the power supply voltage writing module 13, a drain electrically connected to the output terminal 132 of the power supply voltage writing module 13, and a gate electrically connected to the control terminal 133 of the power supply voltage writing module 13. The light-emitting control module 14 includes a fourth transistor M4, and the fourth transistor M4 includes a source electrically connected to the input terminal 141 of the lighting control module 14, a drain electrically connected to the output terminal 142 of the lighting control module 14, and a gate electrically connected to the control terminal 143 of the light-emitting control module 14. The first reset module 15 includes a fifth transistor M5, and the fifth transistor M5 includes a source electrically connected to the input terminal 151 of the first reset module 15, a drain electrically connected to the output terminal 152 of the first reset module 15, and a gate electrically connected to the control terminal 153 of the first reset module 15. The second reset module 16 includes a sixth transistor M6, and the sixth transistor M6 includes a source electrically connected to the input terminal 161 of the second reset module 16, a drain electrically connected to the output terminal 162 of the second reset module 16, and a gate electrically connected to the control terminals 163 of the second reset module 16.

The operating process of the pixel circuit shown in FIG. 3 will be described below with reference to FIG. 3 and FIG. 4.

The following description is presented by taking the example where the first transistor M1, the second transistor M2, the third transistor M3, the fourth transistor M4, the fifth transistor M5, and the sixth transistor M6 are P-type transistors. In other embodiments, any one of these transistors can be an N-type transistor.

As shown in FIG. 4, the first phase T1 includes a reset phase E0 performed before the data writing phase E1. When displaying a frame of an image, the pixel circuit 10 shown in FIG. 3 executes the first phase T1 and the second phase T2. The first phase T1 includes a reset phase E0, a data writing phase E1, and a light-emitting phase E2. The second phase T2 includes an adjusting phase E3 and a light-emitting phase E2.

During the reset phase E0 of the first phase T1, the third scanning line S3 transmits a turn-on signal, that is, a low level signal, and the third transistor M3 is turned on; the first scanning line S1, the second scanning line S2, and a light-emitting control signal line EM each transmit a turn-off signal, i.e., a high level signal, and the first transistor M1, the second transistor M2, the fourth transistor M4, the fifth transistor M5, and the sixth transistor M6 are turned off. The reset voltage Vref is transmitted to a gate of the driving transistor Td through the turned-on third transistor M4 to reset of the gate of the driving transistor Td. Since the gate of the driving transistor Td is connected to a first capacitor C1, the reset voltage Vref can be stored at the gate of the driving transistor Td.

During the data writing phase E1 of the first phase T1, the first scanning line S1 transmits a turn-on signal, that is, a low level signal, and the first transistor M1 and the sixth transistor M6 are turned on; the second scanning line S2 transmits a turn-on signal, that is, a low level signal, and the second transistor M2 is turned on; the third scanning line S3 and the light-emitting control signal line EM each transmit a turn-off signal, i.e., a high level signal, and the third transistor M3, the fourth transistor M4, and the fifth transistor M5 are turned off. At the same time, a source of the first transistor M1 receives a data voltage Vdata, and the data voltage Vdata is transmitted to the source of the driving transistor Td through the turned-on first transistor M1. At the beginning point of the data writing phase E1, a potential of the gate of the driving transistor Td is the reset voltage Vref, a potential of the source of the driving transistor Td is the data voltage signal Vdata, and the potential difference between the source and the gate of the driving transistor Td is (Vdata−Vref) and is greater than 0. Therefore, the driving transistor Td is turned on, and the data voltage Vdata is transmitted to the gate of the driving transistor Td through the turned-on driving transistor Td and the turned-on second transistor M2, so that the potential of the gate of the driving transistor Td gradually increases. When the potential of the gate of the driving transistor Td is equal to (Vdata−|Vth|), the driving transistor Td is turned off. In this case, with the first capacitor C1, the potential of the gate of the driving transistor Td is maintained at (Vdata−|Vth|) during the data writing phase E1.

Meanwhile, the source of the sixth transistor M6 receives the reset voltage Vref, and the reset voltage Vref resets the first electrode 31 of the light-emitting element 30 through the turned-on sixth transistor M6. In some embodiments, the light-emitting element 30 includes an organic light-emitting diode, and the reset voltage Vref resets an anode of the organic light-emitting diode through the turned-on sixth transistor M6.

During the light-emitting phase E2 of the first phase T1, the first scanning line S1, the second scanning line S2, and the third scanning line S3 each transmit a turn-off signal, i.e., a high level signal, the first transistor M1, the second transistor M2, the third transistor M3, and the sixth transistor M6 are turned off; the light-emitting control signal line EM transmits a turn-on signal, i.e., a low level signal, and the fourth transistor M4 and the fifth transistor M5 are turned on. Meanwhile, the power supply voltage signal line DL1 transmits a power supply voltage VDD, that is, the potential of the source of the driving transistor Td is the power supply voltage VDD. Since the potential of the power supply voltage VDD is greater than the potential of the data voltage Vdata, the driving transistor Td generates a light-emitting driving current and transmits the light-emitting driving current to the light-emitting element 30 through the fifth transistor M5 to control the light-emitting element 30 to emit light.

During the adjusting phase E3 of the second phase T2, the first scanning line S1 transmits a turn-on signal, i.e., a low level signal, the first transistor M1 and the sixth transistor M6 are turned on; the second scanning line S2, the third scanning line S3, and the light-emitting control signal line EM all transmit a turn-off signal, i.e., a high level signal, and the second transistor M2, the third transistor M3, the fourth transistor M4, and the fifth transistor M5 are all turned off. Meanwhile, a source of the first transistor M1 receives the adjusting voltage V1, and the adjusting voltage V1 corresponds to the threshold voltage Vth of the driving transistor Td. The adjusting voltage V1 is transmitted to the source of the driving transistor Td through the turned-on first transistor M1, thereby adjusting a bias state of the driving transistor Td. Meanwhile, a source of the sixth transistor M6 receives the reset voltage Vref, and the reset voltage Vref resets a first electrode 31 of the light-emitting element 30 through the turned-on sixth transistor M6.

It can be understood that, during the adjusting phase E3, the reset voltage Vref resets the first electrode 31 of the light-emitting element 30 through the turned on sixth transistor M6, and does not affect the adjustment of the bias state of the driving transistor Td. The light-emitting element 30 is reset once by the reset voltage Vref before emitting light during each of the first phase T1 and the second phase T2, which is beneficial to reduce the difference in light-emitting brightness of the light-emitting element 30 during the first phase T1 and the second phase T2.

The light-emitting phase E2 of the second phase T2 is the same as the light-emitting phase E2 of the first phase T1, and details are not repeated herein.

Referring to FIG. 1, in some embodiments of the present disclosure, the display apparatus 100 has a first region AA and a second region BB, and the first region AA and the second region BB each can be the display region where the pixel circuit 10 is provided, and the threshold detection module 20 can detect the threshold voltage Vth of the driving transistor Td in the pixel circuit 10 in each of the first region AA and the second region BB.

Among the threshold voltages Vth of the driving transistors Td detected by the threshold detection module 20, a difference between at least one threshold voltage Vth of the driving transistor Td located in the first region AA and at least one threshold voltage Vth of the driving transistor Td located in the second region BB is greater than or equal to a first preset value. When the difference between the threshold voltages Vth of the two driving transistors Td is greater than or equal to the first preset value, the characteristics of the two driving transistors Td are quite different.

For example, when the difference between the threshold voltages Vth of the two driving transistors Td is greater than or equal to the first preset value, the operating characteristics of the two driving transistors are significantly different, for example, speeds at which the two driving transistors generate light-emitting driving currents are significantly different. When the difference between the threshold voltages Vth of the two driving transistors Td is smaller than the first preset value, the difference in the operating characteristics of the two driving transistors is small, for example, a difference between ramping speeds of the light-emitting driving currents generated by the two driving transistors is small.

In some embodiments, the first preset value is 0.25V.

An adjusting voltage V1 received by the pixel circuit 10 located in the first region AA is different from an adjusting voltage V1 received by the pixel circuit 10 located in the second region BB. That is, the driving transistor Td in the first region AA and the driving transistor Td in the second region BB can receive different adjusting voltages V1.

The embodiments of the present disclosure can minimize the difference between the bias state of the driving transistor Td in the first region AA and the bias state of the driving transistor Td in the second region BB during the second phase T2 and the first phase T1 of a same frame, so that the difference in brightness between the first region AA and the second region BB during the first phase T1 and the second phase T2 can be smaller, thereby realizing fine control of different display regions in the display apparatus 100, and improving the overall display effect of the display apparatus 100.

When the difference between the threshold voltage Vth of the driving transistor Td in the first region AA and the threshold voltage Vth of the driving transistor Td in the second region BB is smaller than the first preset value, that is, the difference between the characteristic of the driving transistor Td in the first region AA and the characteristic of the driving transistor Td in the second region BB are small, in order to reduce the power consumption of the display apparatus 100, the driving transistor Td in the first region AA and the driving transistor Td in the second region BB can receive the regulation voltages V1 of a same value.

Figure 5:
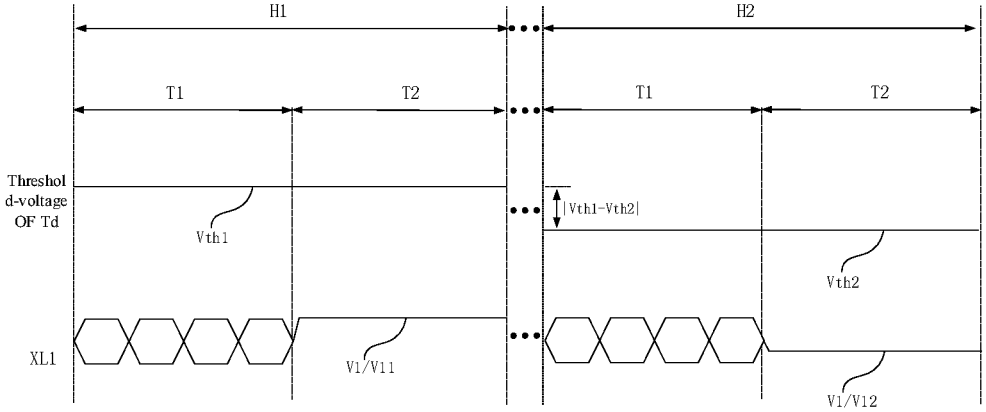
FIG. 5 is a timing sequence of a display apparatus according to some embodiments of the present disclosure.

FIG. 5 is a timing sequence of a display apparatus according to some embodiments of the present disclosure.

In some embodiments of the present disclosure, images displayed on the display apparatus 100 includes a first frame image H1 and a second frame image H2, and a difference between the threshold of the driving transistor Td detected by the threshold detection module 20 during the first frame image H1 and the threshold of this driving transistor Td detected by the threshold detection module 20 during the second frame image H2 is greater than or equal to a second preset value. When the difference between the threshold voltages Vth of the driving transistor Td during these two frame images is greater than or equal to the second preset value, the operating characteristics of the driving transistor Td during these two frame images are quite different.

When the difference between the threshold voltages Vth of the driving transistor Td during the two frame images is greater than or equal to the second preset value, the operating characteristics of the driving transistor Td during these two frame images are quite different, for example, there is a significant difference in the speed at which the driving transistor Td generates the light-emitting driving current during the two frame images. When the difference between the threshold voltages Vth of the driving transistor Td during these two frame images is smaller than the second preset value, the difference in the operating characteristics of the driving transistor Td during the two frame images is small, for example, the speed difference for the driving transistor Td in generating the light-emitting driving current during the two frame images is small.

In some embodiments, the second preset value is the same as the first preset value.

The adjusting voltage V1 received by the pixel circuit 10 to which the driving transistor Td belongs during the first frame image H1 is different from the adjusting voltage V1 received by the pixel circuit 10 during the second frame H2.

For example, as shown in FIG. 5, the threshold voltage of the driving transistor Td detected by the threshold detection module 20 during the first frame image H1 is the first threshold voltage Vth1, and the threshold voltage of this driving transistor Td detected by the threshold detection module 20 during the second frame H2 is the second threshold voltage Vth2, the difference between the first threshold voltage Vth1 and the second threshold voltage Vth2 is |Vth1−Vth2|, and |Vth1−Vth2| is greater than or equal to the second preset value. The adjusting voltage V1 received by the pixel circuit 10 to which the driving transistor Td belongs during the first frame image H1 is the first adjusting voltage V11, and the adjusting voltage V1 received during the second frame image H2 is the second adjusting voltage V12, then the first adjusting voltage V11 is different from the second adjusting voltage V12.

When the difference between the threshold voltage Vth of the driving transistor Td detected by the threshold detection module 20 during the first frame image H1 and the threshold voltage Vth of the driving transistor Td detected by the threshold detection module 20 during the second frame image H2 is smaller than the second preset value, the adjusting voltage V1 received by the pixel circuit 10 to which the driving transistor Td belongs during the first frame image H1 can be the same as the adjusting voltage V1 received by this pixel circuit 10 during the second frame H2.

In some embodiments, the threshold voltage Vth of the driving transistor Td during the first frame image H1 can be detected by the threshold detection module 20 during the first frame image H1, or can be detected by the threshold detection module 20 during a frame image prior to the first frame image H1.

When a frequency at which the threshold detection module 20 detects the threshold voltage Vth of the driving transistor Td is lower than a refresh frequency of the frame image, that is, when the threshold detection module 20 detects the threshold voltage Vth of the driving transistor Td during only at least one of the frame images, the threshold voltage Vth of the driving transistor Td detected by the threshold detection module 20 during one frame image can be used as the threshold voltage Vth of this driving transistor Td during a frame to which the driving transistor Td belongs before the next detection.

For example, the images displayed on the display apparatus 100 include a third frame image, a fourth frame image, a fifth frame image, and a sixth frame image that are displayed in sequence, and the threshold detection module 20 detects the threshold voltage Vth of the driving transistor Td during only the third frame image and the fifth frame image, then the threshold voltage Vth of the driving transistor Td during each of the third frame image and the fourth frame image is the threshold voltage Vth of the driving transistor Td detected by the threshold detection module 20 during the third frame image, the threshold voltage Vth of the driving transistor Td during the fifth frame and the sixth frame is the threshold voltage Vth of the driving transistor Td detected by the threshold detection module 20 during the fifth frame image.

Figure 6:
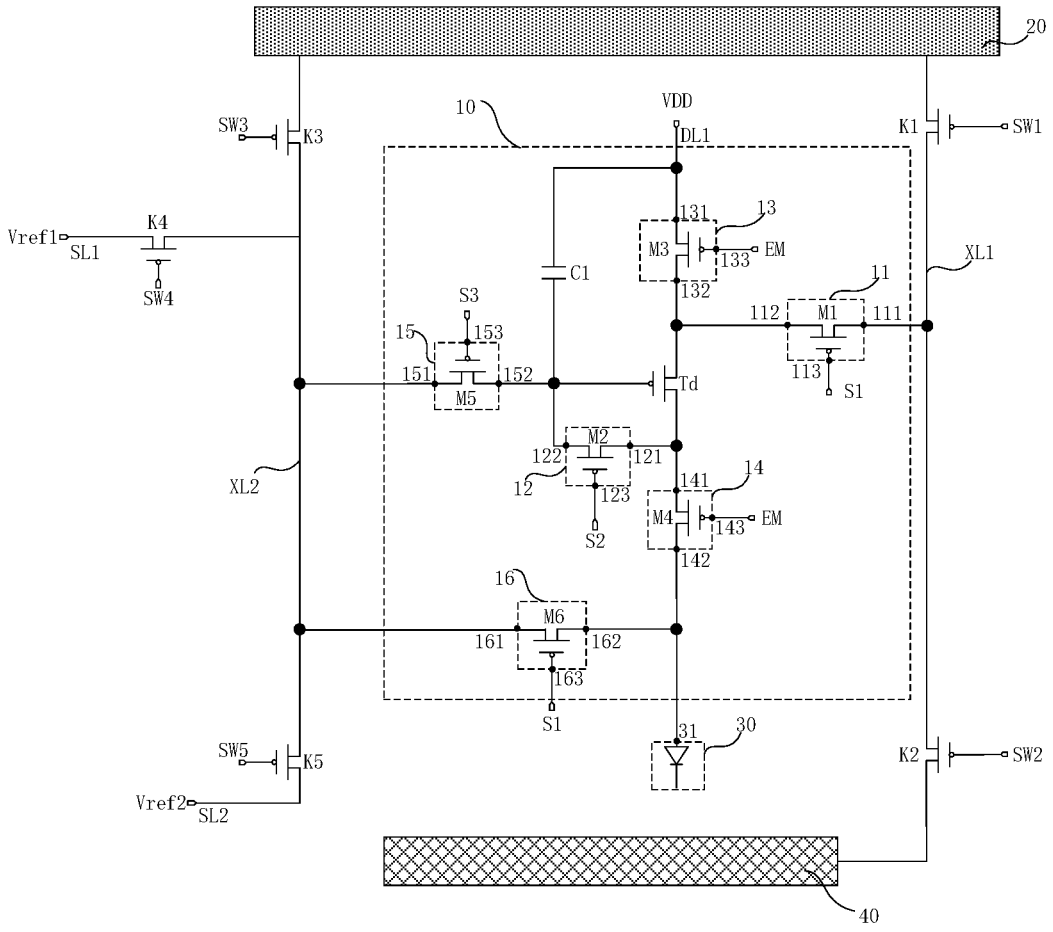
FIG. 6 is a schematic diagram of a circuit of the threshold detection module for detecting a threshold voltage of the driving transistor in FIG. 1 according to some embodiments of the present disclosure.
Figure 7:
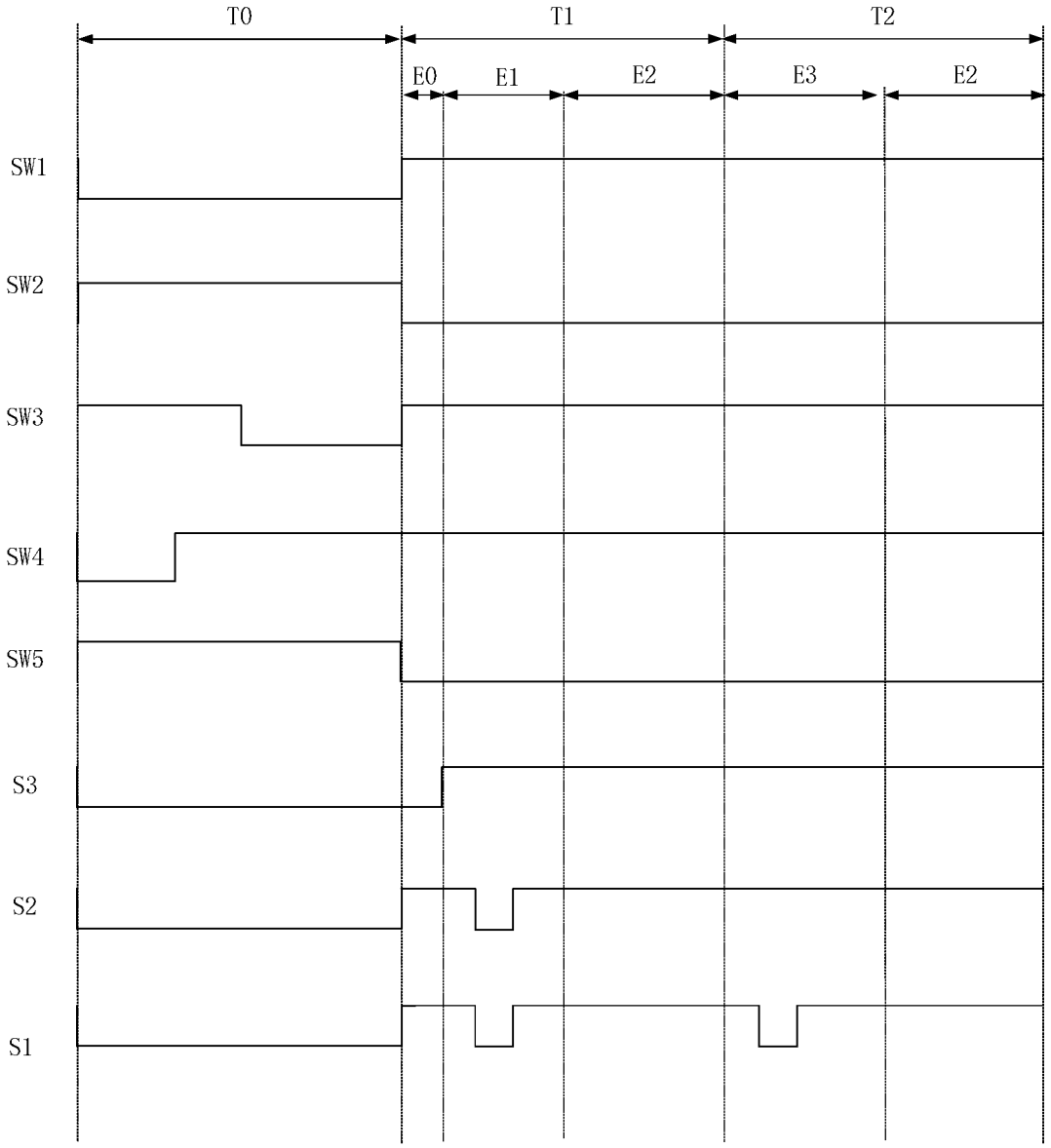
FIG. 7 is a timing sequence of the circuit shown in FIG. 6 according to some embodiments of the present disclosure.

FIG. 6 is a schematic diagram of a circuit of the threshold detection module for detecting a threshold voltage of the driving transistor in FIG. 1, and FIG. 7 is a timing sequence of the circuit shown in FIG. 6.

In some embodiments of the present disclosure, with reference to FIG. 6 and FIG. 7, the display apparatus 100 includes multiple detection phases T0. During the detection phase T0, the threshold detection module 20 detects the threshold voltage Vth of the driving transistor Td in the pixel circuit 10.

Before the pixel circuit 10 performs the first phase T1, the threshold detection module 20 detects the threshold voltage Vth of the driving transistor Td in the pixel circuit 10.

That is to say, the detection phase T0 can be performed prior to the first phase T1 of a frame image. The detection phase T0 can be performed before the first phase T1 of each frame image, or can be performed before the first phase T1 of only some of frame images.

The embodiments of the present disclosure can prevent the detection phase T0 from affecting the operating process of the pixel circuit 10, thereby ensuring that the driving transistor Td in the pixel circuit 10 receives an accurate data voltage Vdata, thereby generating a required light-emitting driving current.

Figure 8:
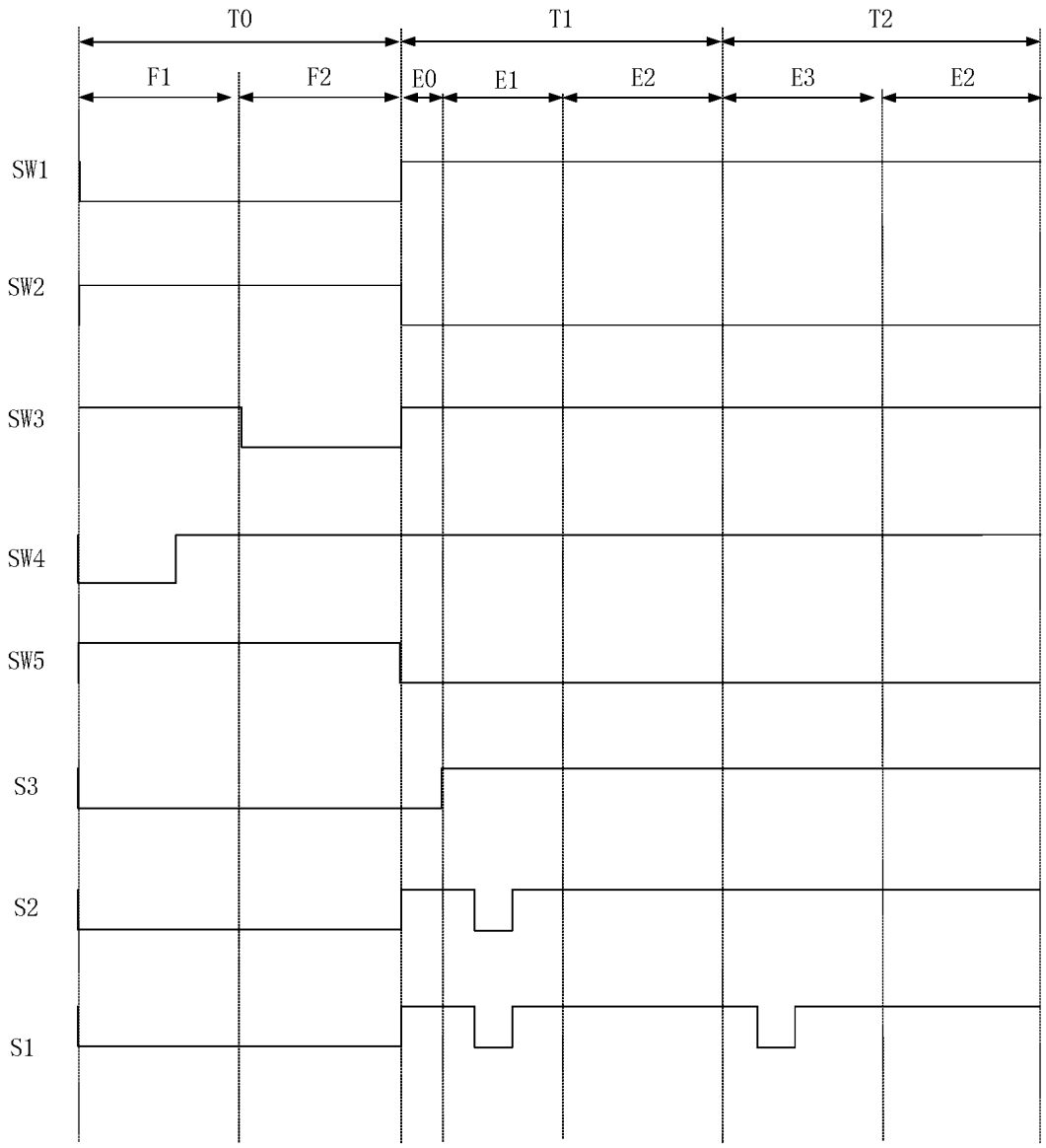
FIG. 8 is another timing sequence of the circuit shown in FIG. 6 according to some embodiments of the present disclosure.

FIG. 8 is another timing sequence of the circuit shown in FIG. 6.

In some embodiments of the present disclosure, with reference to FIG. 6 and FIG. 8, the detection phase T0 includes a third phase F1 and a fourth phase F2.

The threshold detection module 20 transmits a detection voltage Vsense to the first electrode of the driving transistor Td during the third phase F1, that is, the first electrode of the driving transistor Td receives the detection voltage Vsense during the third phase F1. The second electrode of the driving transistor Td receives the first reset voltage Vref1 during the third phase F1, and the driving transistor Td is turned on during the third phase F1.

The driving transistor Td is turned off during the fourth phase F2, and the threshold detection module 20 collects a potential of the second electrode of the driving transistor Td during the fourth phase F2.

In some embodiments, as shown in FIG. 6, taking the driving transistor Td being a P-type transistor as an example, the first electrode of the driving transistor Td can be the source of the driving transistor Td, and the second electrode of the driving transistor Td can be the gate of the driving transistor Td pole. During the third phase F1, the second transistor M2 electrically connected between the gate and the drain of the driving transistor Td is turned on. During the initial phase of the third phase F1, the potential of the first electrode of the driving transistor Td is the detection voltage Vsense, and the potential of the second electrode of the driving transistor Td is the first reset voltage Vref1. Since the driving transistor Td is turned on during the third phase F1, the detection voltage Vsense is transmitted to the second electrode of the driving transistor Td through the turned-on driving transistor Td and the second transistor M2, so that the potential of the second electrode of the driving transistor Td is gradually increased. When the potential of the second electrode of the driving transistor Td is equal to (Vsense−|Vth|), the driving transistor Td is turned off, and the display apparatus 100 begins to enter the fourth phase F2 of the detection phase T0.

During the fourth phase F2, the second transistor M2, which is electrically connected between the gate and the drain of the driving transistor Td, can keep a turn-on state. The second transistor M2 can also be turned off during the fourth phase F2.

During the fourth phase F2, with the first capacitor C1, the potential of the second electrode of the driving transistor Td can be maintained at (Vsense−|Vth|), and the threshold detection module 20 collects the potential of the second electrode of the driving transistor Td during the fourth phase F2. That is to say, the threshold detection module 20 collects the potential (Vsense−|Vth|). Since the detection voltage Vsense is transmitted by the threshold detection module 20 itself, after the threshold detection module 20 collects the potential (Vsense−|Vth|), the threshold voltage Vth of the driving transistor Td can be obtained.

It can be understood that the threshold detection module 20 is electrically connected to the display chip 40, and the display chip 40, according to the threshold voltage Vth detected by the threshold detection module 20, generates an adjusting voltage V1 corresponding to the threshold voltage Vth during the adjusting phase E2

Figure 9:
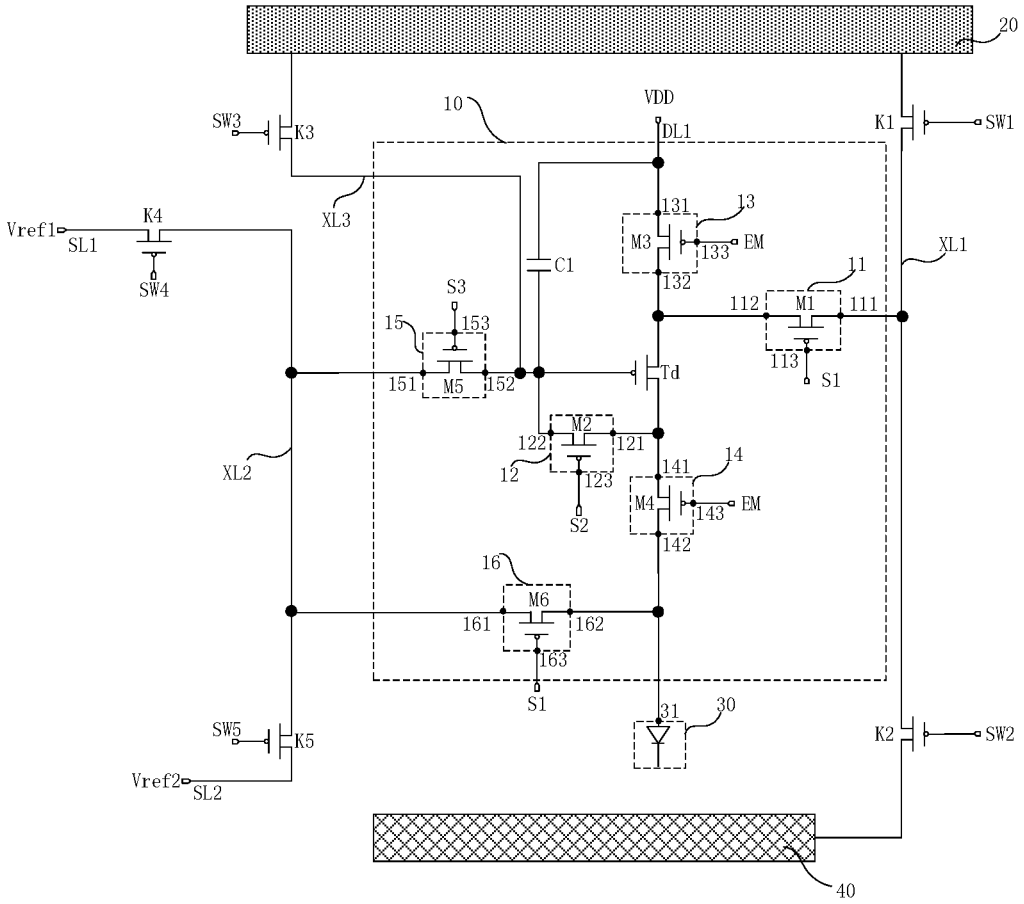
FIG. 9 is another schematic diagram of a circuit of the threshold detection module for detecting a threshold voltage of the driving transistor in FIG. 1 according to some embodiments of the present disclosure.
Figure 10:
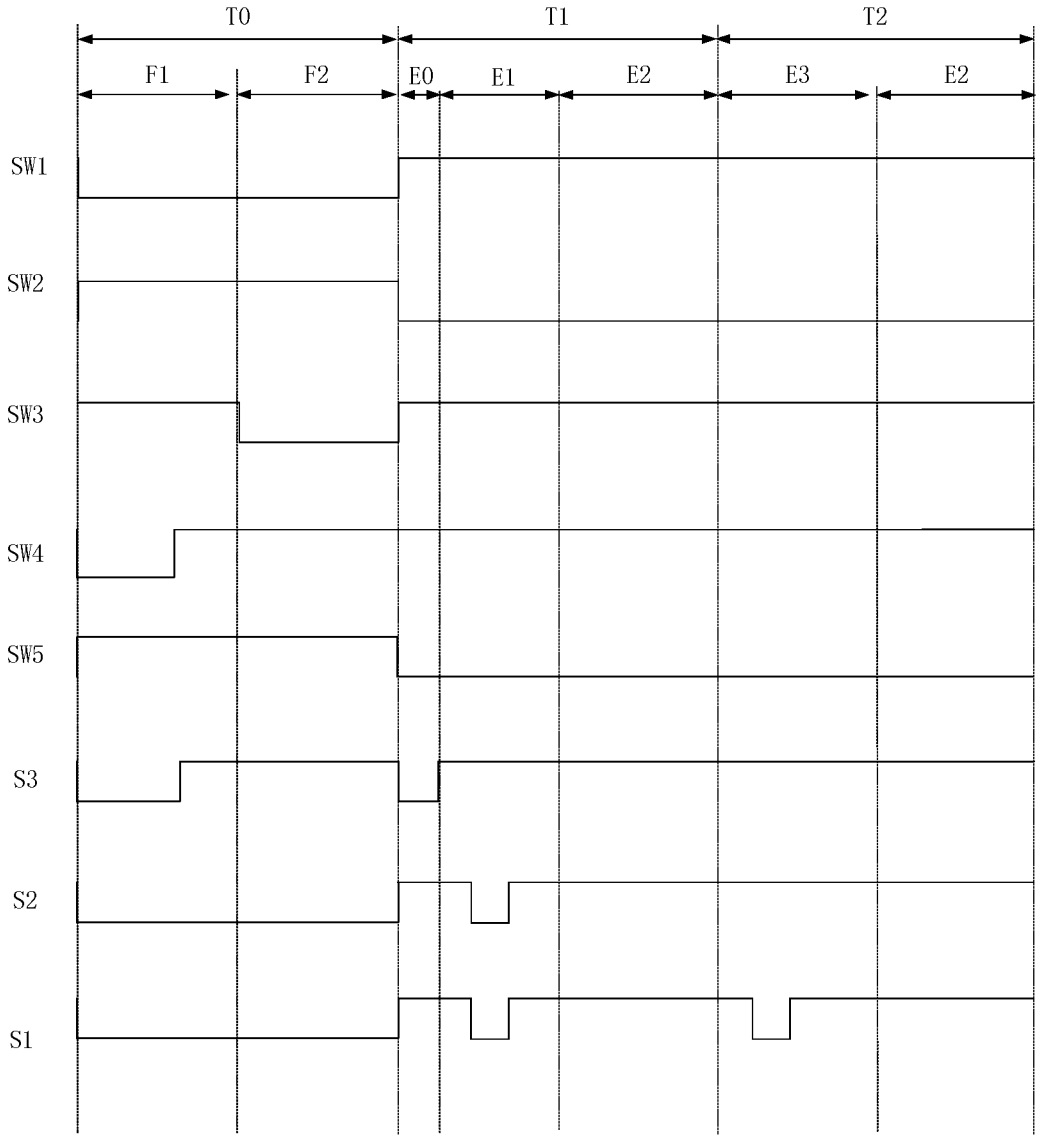
FIG. 10 is a timing sequence of the circuit shown in FIG. 9 according to some embodiments of the present disclosure.

FIG. 9 is another schematic diagram of a circuit of the threshold detection module for detecting a threshold voltage of the driving transistor in FIG. 1, and FIG. 10 is a timing sequence of the circuit shown in FIG. 9.

In some embodiments of the present disclosure, as shown in FIG. 6 or FIG. 9, the data voltage writing module 11 is electrically connected to the first electrode of the driving transistor Td, and the data voltage writing module 11 is turned on during the third phase F1, the threshold detection module 20 transmits the detection voltage Vsense to the first electrode of the driving transistor Td through the turned-on data voltage writing module 11 during the third phase F1.

In some embodiments, an input terminal 111 of the data voltage writing module 11 is electrically connected to the first signal line XL1, and an output terminal 112 of the data voltage writing module 11 is electrically connected to the first electrode of the driving transistor Td. The display apparatus 100 can include a first switch K1, a first terminal of the first switch K1 is electrically connected to the threshold detection module 20, a second terminal is electrically connected to the first signal line XL1, and the first switch K1 is turned on during the third phase F1.

That is to say, during the third phase F1, the first switch K1 and the data voltage writing module 11 are both turned on, and the detection voltage Vsense transmitted by the threshold detection module 20 is transmitted to the first electrode of the driving transistor Td through the turned-on first switch K1 and the data voltage writing module 11.

In some embodiments, a control terminal of the first switch K1 is electrically connected to the first control line SW1, and the first control line SW1 transmits an effective signal to control the first switch K1 to be turned on during the third phase F1.

In some embodiments, the first switch K1 is a P-type transistor. In some embodiments, the first switch K1 can also be an N-type transistor.

The first switch K1 can be keep a turn-on state during the fourth phase F2, and can keep a turn-off state during the first phase T1 and the second phase T2.

Referring to FIG. 6 or FIG. 9, the pixel circuit 10 can include a first reset module 15, an input terminal 151 of the first reset module 15 is electrically connected to a second signal line XL2, and an output terminal 152 of the first reset module 15 is electrically connected to the second electrode of the driving transistor Td, the first reset module 15 is turned on during the third phase F1, and the first reset module 15 transmits the first reset voltage Vref1 to the second electrode of the driving transistor Td during the third phase F1. That is, during the third phase F1, the first reset voltage Vref1 is transmitted to the second electrode of the driving transistor Td through the turned-on first reset module 15.

The first reset voltage Vref1 transmitted by the first reset module 15 during the third phase F1 can be the same as or different from the reset voltage Vref transmitted by the first reset module 15 during the reset phase E0 of the first phase T1.

In some embodiments, the display apparatus 100 can include a fourth switch K4, a first terminal of the fourth switch K4 is electrically connected to the first reset voltage signal line SL1, and a second terminal of the fourth switch K4 is electrically connected to the second signal line XL2. The fourth switch K4 is turned on during the third phase F1, the fourth switch K4 transmits the first reset voltage Vref1 to the second signal line XL2, and the fourth switch K4 is turned off during the fourth phase F2.

That is, during the third phase F1, the first reset voltage Vref1 transmitted by the first reset voltage signal line SL1 is transmitted to the second electrode of the driving transistor Td through the turned-on fourth switch K4 and the first reset module 15. During the fourth phase F2, the fourth switch K4 is turned off, and the second electrode of the driving transistor Td stops receiving the first reset voltage Vref1.

In some embodiments, a control terminal of the fourth switch K4 is electrically connected to a fourth control line SW4. During the third phase F1, the fourth switch K4 transmits an effective signal to control the fourth switch K4 to be turned on. During the fourth phase F2, the fourth control line SW4 transmits an effective signal to control the fourth switch K4 to be turned off.

During the third phase F1, after the potential of the second electrode of the driving transistor Td becomes the first reset voltage Vref1, the fourth switch K4 can be turned off.

In a first solution, as shown in FIG. 6, the display apparatus 100 includes a third switch K3, a first terminal of the third switch K3 is electrically connected to the threshold detection module 20, and a second terminal is electrically connected to the threshold detection module 20. The first reset module 15 and the third switch K3 are turned on during the fourth phase F2, and the threshold detection module 20 collects the potential of the second electrode of the driving transistor Td through the turned-on first reset module 15 and the third switch K3.

That is to say, during the fourth phase F2, the threshold detection module 20 collects the potential (Vsense−|Vth|) of the second electrode of the driving transistor Td through the turned-on first reset module 15 and the third switch K3, thereby obtaining the threshold voltage Vth of the driving transistor Td.

In some embodiments, a control terminal of the third switch K3 is electrically connected to a third control line SW3. During the fourth phase F2, the third control line SW3 transmits an effective signal to control the third switch K3 to be turned on. During the first phase T1 and the second phase T2, the third control line SW3 transmits an effective signal to control the third switch K3 to be turned on.

In a second solution, with reference to FIG. 9 and FIG. 10, the display apparatus 100 includes a third switch K3 and a third signal line XL3, and the third signal line XL3 is electrically connected to the second electrode of the driving transistor Td. A first terminal of the third switch K3 is electrically connected to the threshold detection module 20, and a second terminal of the third switch K3 is electrically connected to the third signal line XL3.

The third switch K3 is turned on during the fourth phase F2, and the first reset module 15 is turned off during the fourth phase F2, and the threshold detection module 20 collects the potential of the second electrode of the driving transistor Td through the third switch K3 during the fourth phase F2.

In the two solutions, in some embodiments, the third switch K3 is turned off during the first phase T1 and the second phase T2 to prevent the threshold detection module 20 from affecting the operating process of the pixel circuit 10.

The only difference between the circuit shown in FIG. 9 and the circuit shown in FIG. 6 lies in that the circuit shown in FIG. 9 includes the third signal line XL3, and the third switch K3 is electrically connected to the third signal line XL3. Compared with the timing sequence shown in FIG. 7, the timing sequence shown in FIG. 10 is changed in that: the first reset module 15 is turned off during the fourth phase F2.

In some embodiments, during the third phase F1 of the detection phase T0, the threshold detection module 20 transmits the detection voltage Vsense to the first electrode of the driving transistor Td through the turned-on first switch K1 and the data voltage writing module 11. At the same time, the first reset voltage Vref1 transmitted by the first reset voltage signal line SL1 is transmitted to the second electrode of the driving transistor Td through the turned-on fourth switch K4 and the first reset module 15. The driving transistor Td is turned on under the control of the potential Vsense of the first electrode of the driving transistor Td and the potential Vref1 of the second electrode of the driving transistor Td, that is, the driving transistor Td is turned on under the control of the potential Vsense of the source of the driving transistor Td and the potential Vref1 of the gate of the driving transistor Td. At the same time, the second transistor M2 electrically connected between the gate and the drain of the driving transistor Td is turned on, and the detection voltage Vsense is transmitted to the second electrode of the driving transistor Td through the turned-on driving transistor Td and the second transistor M2 until the potential of the second electrode of the driving transistor Td is (Vsense−|Vth|), the driving transistor Td is turned off, and the display apparatus 100 begins to enter the fourth phase F2 of the detection phase T0.

During the fourth phase F2 of the detection phase T0, the fourth switch K4 is turned off, the third switch K3 is turned on, and the threshold detection module 20 collects the potential (Vsense−|Vth|) of the second electrode of the driving transistor Td through the turned-on third switch K3 and the first reset module 15, or collects the potential (Vsense−|Vth|) of the second electrode of the driving transistor Td through only the turned-on third switch K3, so as to obtain the threshold voltage Vth of the driving transistor Td.

In some embodiments of the present disclosure, as shown in FIG. 6 or FIG. 9, the display apparatus 100 includes a second switch K2, a first terminal of the second switch K2 is electrically connected to the first signal line XL1, and a second terminal of the second switch K2 is electrically connected to a display chip 40. The second switch K2 is turned on during the first phase T1 and transmits the data voltage Vdata, the second switch K2 is turned on during the second phase T2 and transmits the adjusting voltage V1, and the second switch K2 is turned off during the detection phase T0.

In some embodiments, a control terminal of the second switch K2 is electrically connected to the second control line SW2. During the first phase T1 and the second phase T2, the second control line SW2 transmits an effective signal to control the second switch K2 to be turned on; and during the detection phase T0, the second control line SW2 transmits an effective signal to control the second switch K2 to be turned off.

In combination with the above operating process of the pixel circuit 10, it can be learned that during the data writing phase E1, the data voltage Vdata transmitted by the data voltage writing module 11 to the driving transistor Td is the data voltage Vdata transmitted by the second switch K2 during the first phase T1; and during the adjusting phase E3, the adjusting voltage V1 transmitted by the data voltage writing module 11 to the driving transistor Td is the adjusting voltage V1 transmitted by the second switch K2 during the second phase T2.

In some embodiments of the present disclosure, a situation when the data voltage Vdata or the adjusting voltage V1 affects the detection phase T0 of the display apparatus 100 can be prevented, while ensuring that the data voltage Vdata and the adjusting voltage V1 are transmitted to the pixel circuit 10.

Figure 11:
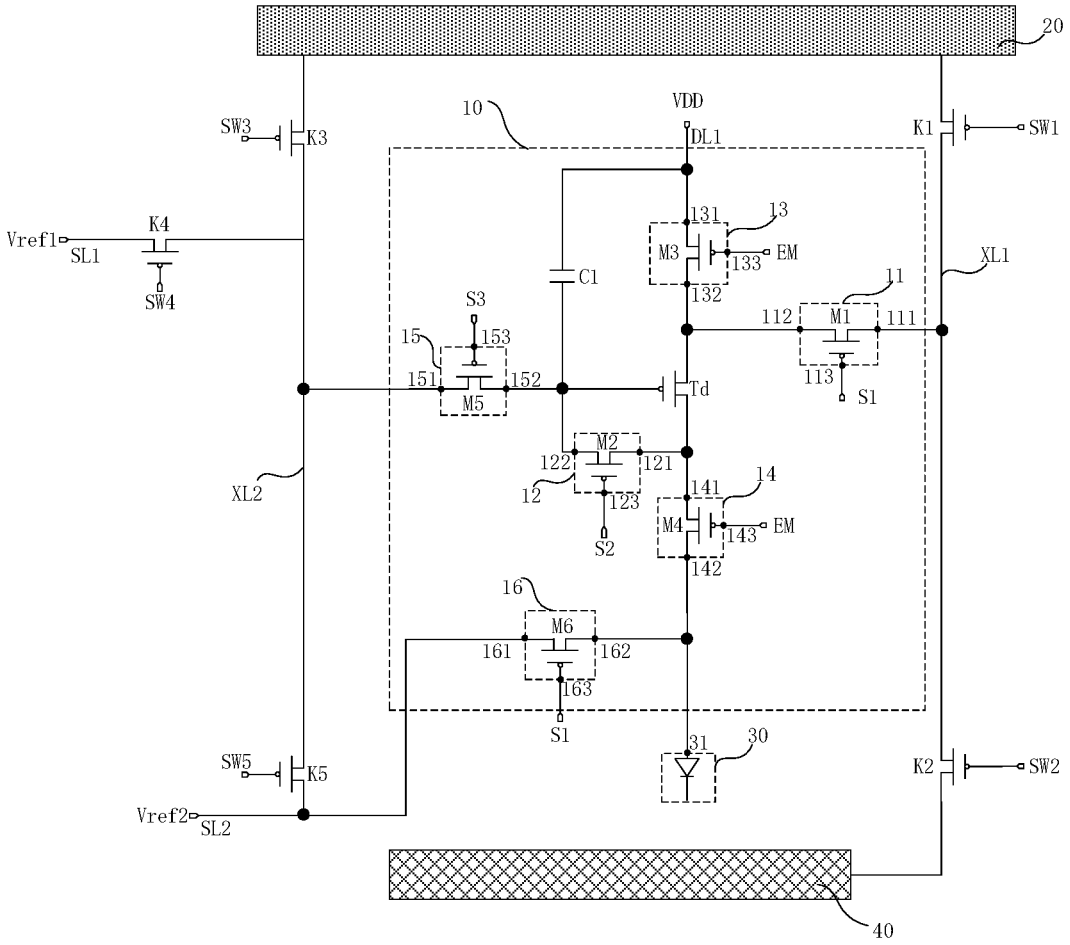
FIG. 11 is another schematic diagram of a circuit of the threshold detection module for detecting a threshold voltage of the driving transistor in FIG. 1 according to some embodiments of the present disclosure.

FIG. 11 is another schematic diagram of a circuit of the threshold detection module for detecting a threshold voltage of the driving transistor in FIG. 1.

Referring to FIG. 6 or FIG. 9, in some embodiments of the present disclosure, the display apparatus 100 includes a fifth switch K5, a first terminal of the fifth switch K5 is electrically connected to a second reset voltage signal line SL2, and a second terminal is electrically connected to the second signal line XL2. The fifth switch K5 is turned off during the detection phase T0, and the fifth switch K5 transmits the second reset voltage Vref2 to the second signal line XL2 during the first phase T1. The fifth switch K5 can also transmit the second reset voltage Vref2 to the second signal line XL2 during the second phase T2.

In some embodiments, a control terminal of the fifth switch K5 is electrically connected to a fifth control line SW5. During the first phase T1 and the second phase T2, the fifth control line SW5 transmits an effective signal to control the fifth switch K5 to be turned on.

In combination with the above operating process of the pixel circuit 10, it can be concluded that the second reset voltage Vref2 transmitted by the fifth switch K5 can be the reset voltage Vref received by the first reset module 15 during the reset phase E0. The second reset voltage Vref2 can also be the reset voltage Vref transmitted by the second reset module 16 in the pixel circuit 10 to the light-emitting element 30.

In some embodiments, as shown in FIG. 6 or FIG. 9, an input terminal 161 of the second reset module 16 can be electrically connected to the second signal line XL2. In other embodiments, as shown in FIG. 11, the input terminal 161 of the second reset module 16 is electrically connected to the second reset voltage signal line SL2.

Figure 12:
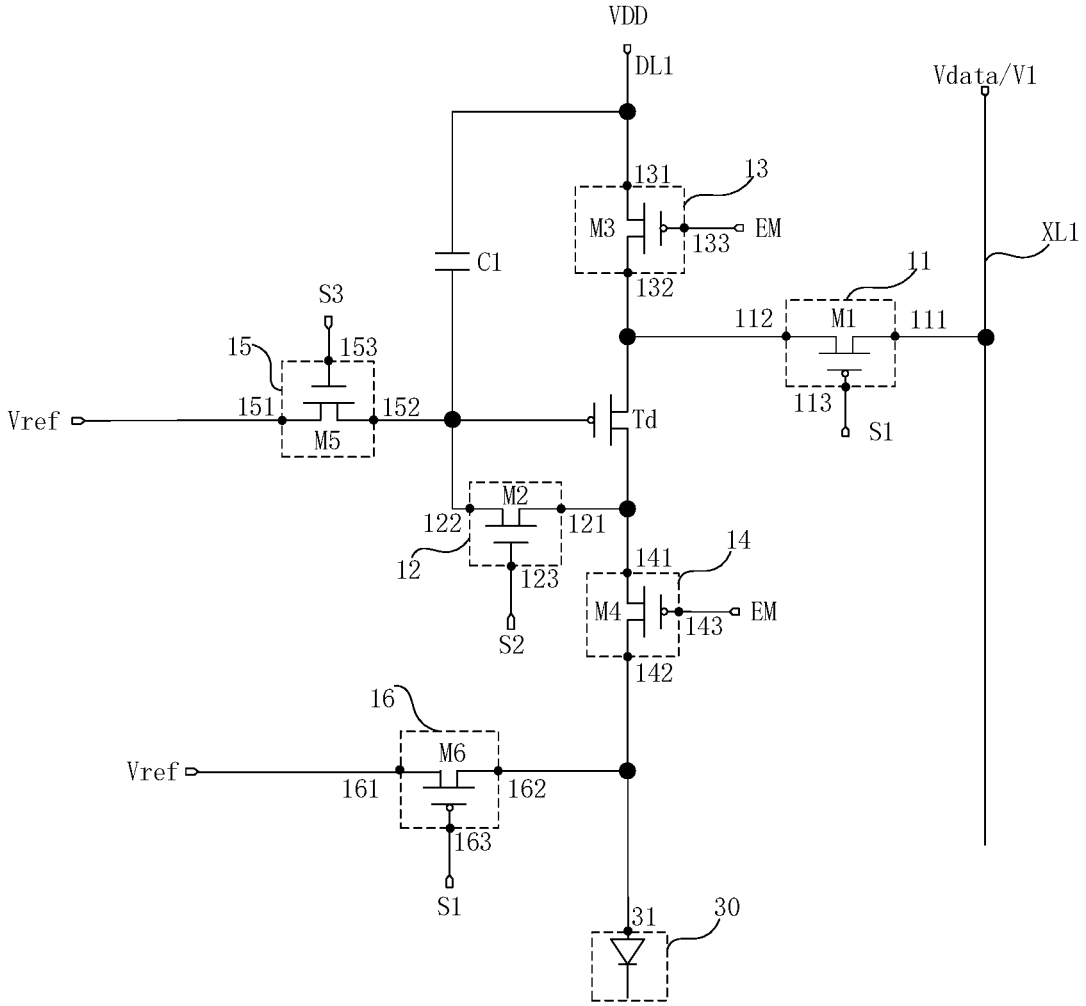
FIG. 12 is another schematic diagram of the pixel circuit shown in FIG. 2 according to some embodiments of the present disclosure.
Figure 13:
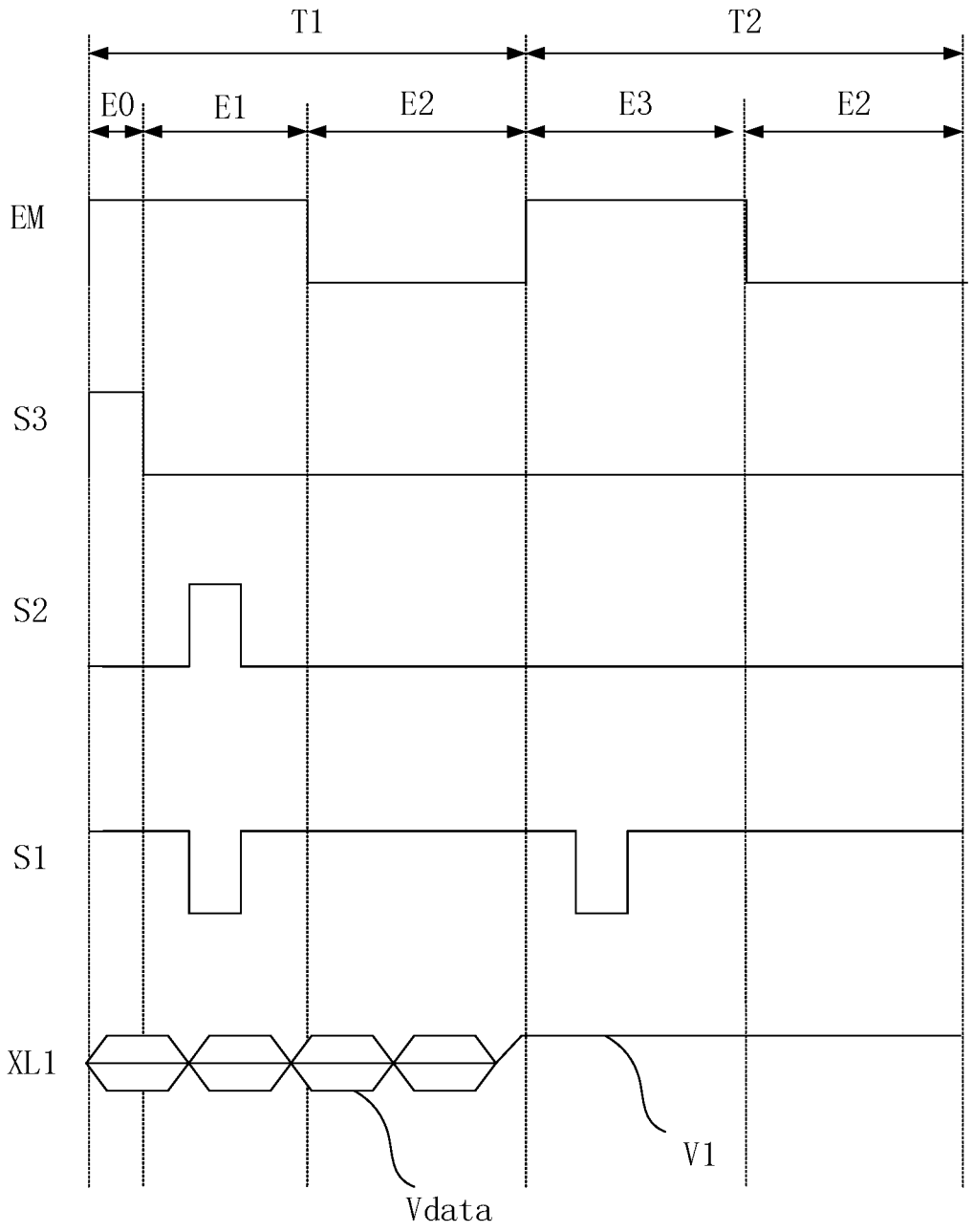
FIG. 13 is a timing sequence of the pixel circuit shown in FIG. 12 according to some embodiments of the present disclosure.

FIG. 12 is another schematic diagram of the pixel circuit shown in FIG. 2, and FIG. 13 is a timing sequence of the pixel circuit shown in FIG. 12.

The pixel circuit 10 shown in FIG. 12 differs from the pixel circuit 10 shown in FIG. 3 only in that the second transistor M2 and the fifth transistor M5 each are an N-type transistor including a metal oxide active layer.

Compared with the timing sequence shown in FIG. 4, as shown in FIG. 13, the change in the timing sequence lies in that the turn-on signals respectively transmitted by the second scanning line S2 and the third scanning line S3 each are a high level signal, and the turn-off signals respectively transmitted by the second scanning line S2 and the third scanning line S3 each are a low level signal.

Figure 14:
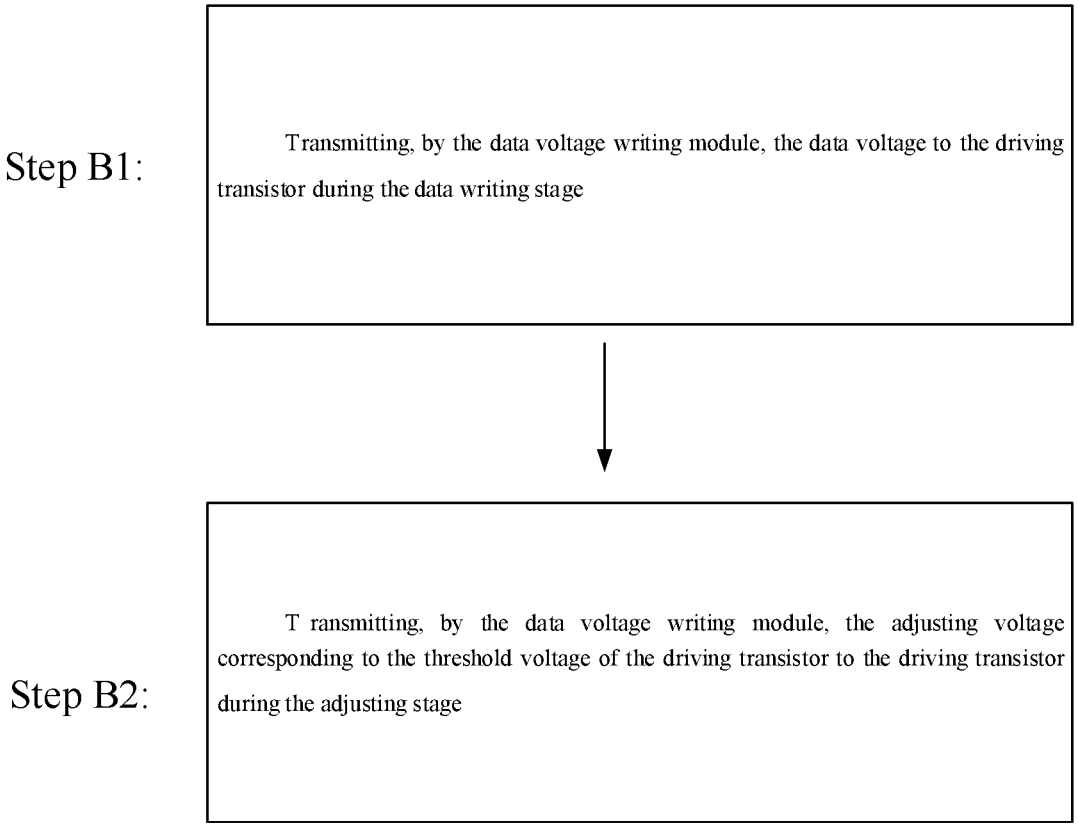
FIG. 14 is a flowchart of a method for driving a display apparatus according to some embodiments of the present disclosure.

FIG. 14 is a flowchart of a method for driving a display apparatus according to some embodiments of the present disclosure.

Embodiments of the present disclosure provide a method for driving a display apparatus, which is configured to drive the display apparatus 100 provided in the above embodiments. The display apparatus 100 includes a pixel circuit 10 and a threshold voltage detection module 20. The structure of the pixel circuit 10 can refer to the schematic diagrams in FIG. 2, FIG. 3, and FIG. 12. The circuit of the threshold voltage detection module 20 for detecting the threshold voltage Vth of the driving transistor Td in the pixel circuit 10 can refer to the schematic diagrams in FIG. 6, FIG. 9, and FIG. 11. The corresponding method for driving the display apparatus can be understood in conjunction with the operating process of the pixel circuit 10 and the process for the threshold voltage detection module 20 to detect the threshold voltage Vth of the driving transistor Td in the above embodiments.

As shown in FIG. 14, the method includes step B1 and step B2.

At step B1, during the data writing phase E1, the data voltage writing module 11 transmits the data voltage Vdata to the driving transistor Td.

AT step B2, during the adjusting phase E3, the data voltage writing module 11 transmits the adjusting voltage V1 corresponding to the threshold voltage Vth of the driving transistor Td to the driving transistor Td.

In the method provided by some embodiments of the present disclosure, during the adjusting phase E3 of the second phase T2, the data voltage writing module 11 transmits the adjusting voltage V1 to the driving transistor Td, so that the bias state of the driving transistor Td can be corrected to reduce the difference between the bias state of the driving transistor Td during the second phase T2 and the bias state of the driving transistor Td during the first phase T1. In this way, the difference in the ramping speed of the current received by the light-emitting element 30 during the first phase T1 and the second phase T2 is reduced, thereby reducing the brightness difference of the display apparatus 100 during the first phase T1 and the second phase T2, and improving the display effect of the display apparatus 100. Since the adjusting voltage V1 transmitted by the data voltage writing module 11 to the driving transistor Td during the adjusting phase E3 corresponds to the threshold voltage Vth of the driving transistor Td, the adjusting voltage V1 received by the driving transistor Td can changes with the characteristic change of the driving transistor Td, and then the difference between the bias states of the driving transistor Td during the second phase T2 and the first phase T1 belonging to a same frame image is minimized, thereby improving the display effect of the display apparatus 100.

Figure 15:
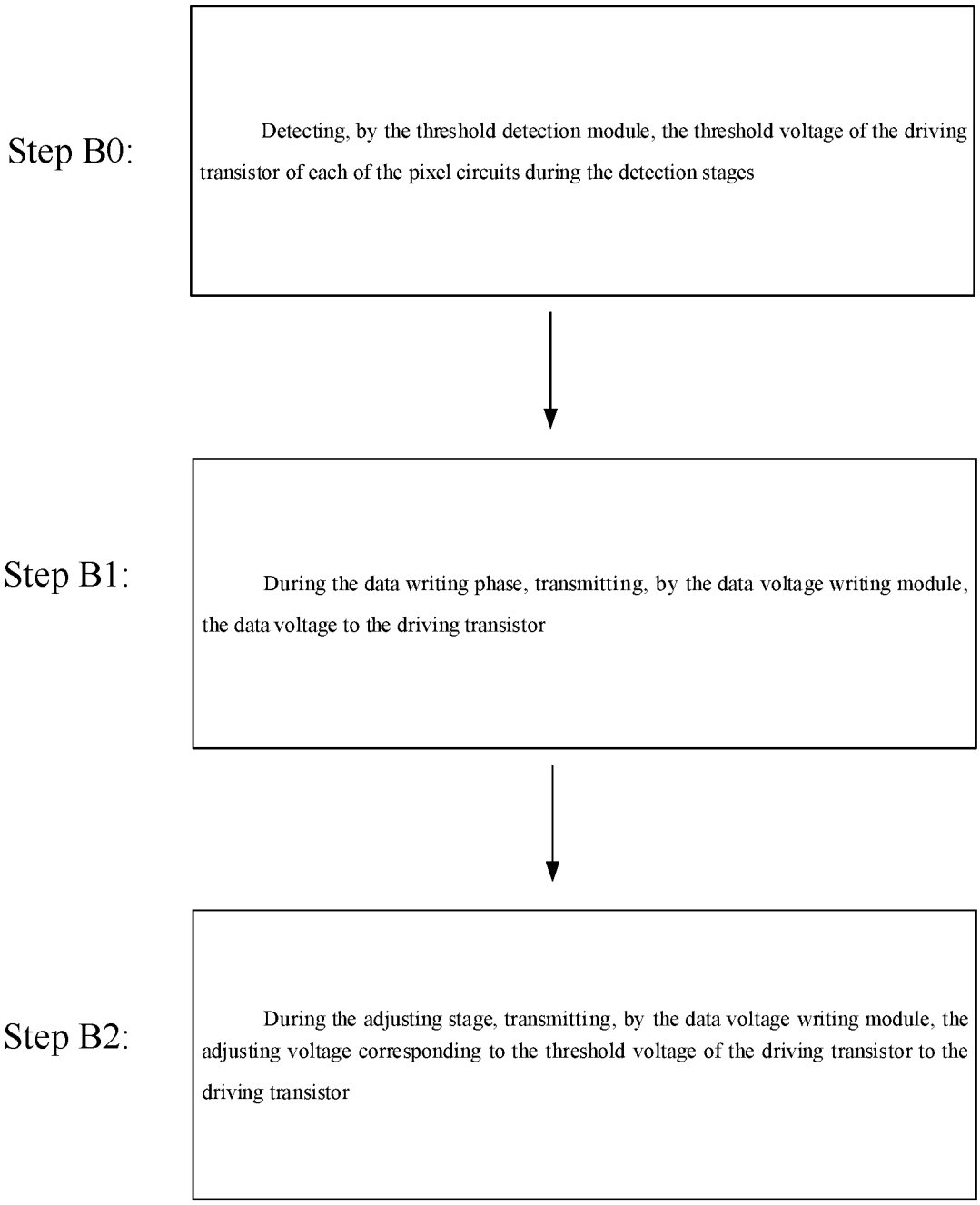
FIG. 15 is another flowchart of method for driving a display apparatus according to some embodiments of the present disclosure.
Figure 16:
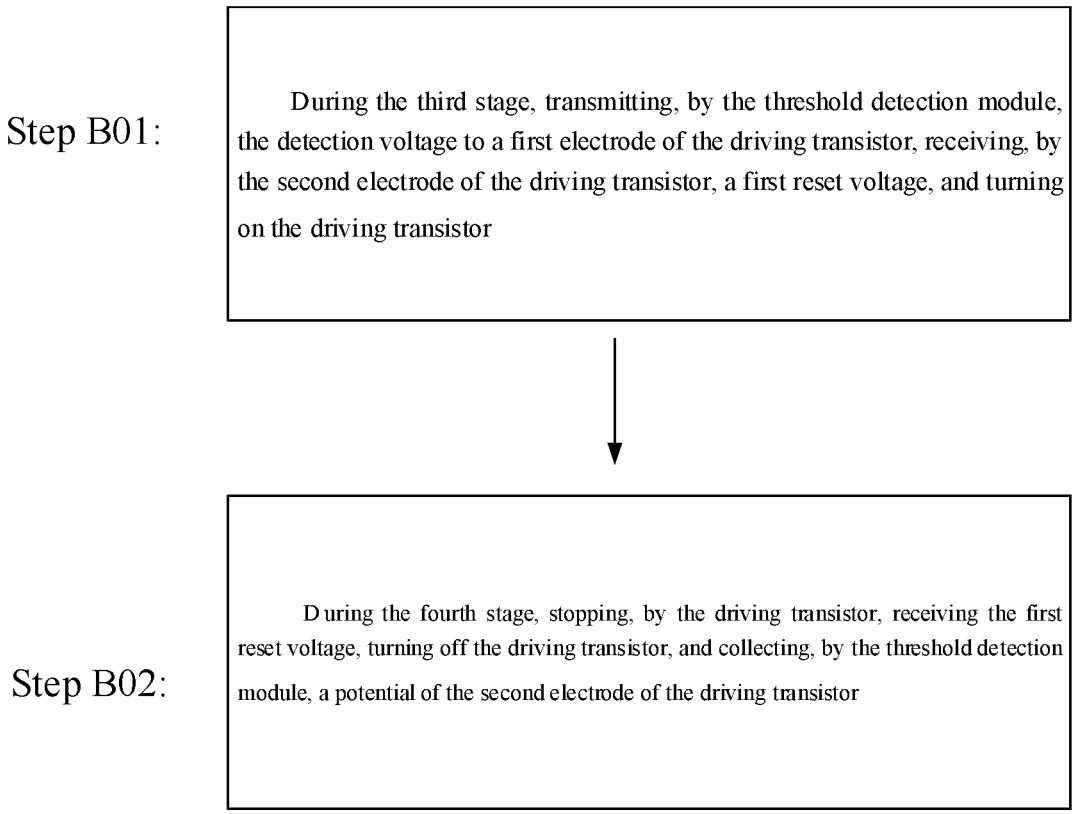
FIG. 16 is a working flow chart of step B0 shown in FIG. 15 according to some embodiments of the present disclosure.

FIG. 15 is a flowchart of another method for driving a display apparatus according to some embodiments of the present disclosure, and FIG. 16 is a flowchart of step B0 shown in FIG. 15.

In some embodiments of the present disclosure, the display apparatus 100 includes multiple detection phases T0, and the detection phases T0 are performed before the first phase T1 of the pixel circuit 10. As shown in FIG. 15, the method can include step B0.

At step B0, during the detection phase T0, the threshold detection module 20 detects the threshold voltage Vth of the driving transistor Td during the pixel circuit 10.

Step B0 is performed before step B1.

In some embodiments, as shown in FIG. 16, the detection phase T0 includes a third phase F1 and a fourth phase F2. The detecting, by the threshold detection module 20, the threshold voltage Vth of the driving transistor Td in the pixel circuit 10, includes step B01 and step B02.

At step B01, during the third phase F1, the threshold detection module 20 transmits the detection voltage Vsense to the first electrode of the driving transistor Td, the second electrode of the driving transistor Td receives the first reset voltage Vref1, and the driving transistor Td is turned on.

At step B02, during the fourth phase F2, the driving transistor Td stops receiving the first reset voltage Vref1, the driving transistor Td is turned off, and the threshold detection module 20 collects the potential of the second electrode of the driving transistor Td.

The first electrode of the driving transistor Td can be the source of the driving transistor Td, and the second electrode of the driving transistor Td can be the gate of the driving transistor Td. During the third phase F1, the second transistor M2 electrically connected between the gate and the drain of the driving transistor Td is turned on. During the initial phase of the third phase F1, the potential of the first electrode of the driving transistor Td is the detection voltage Vsense, and the potential of the second electrode of the driving transistor Td is the first reset voltage Vref1. Since the driving transistor Td is turned on during the third phase F1, then the detection voltage Vsense is transmitted to the second electrode of the driving transistor Td through the turned-on driving transistor Td and the second transistor M2, so that the potential of the second electrode of the driving transistor Td is gradually increased. When the potential of the second electrode of the driving transistor Td is equal to (Vsense−|Vth|), the driving transistor Td is turned off, and the display apparatus 100 begins to enter the fourth phase F2 of the detection phase T0.

During the fourth phase F2, with the first capacitor C1, the potential of the second electrode of the driving transistor Td can be maintained at (Vsense−|Vth|), and the threshold detection module 20 collects the potential of the second electrode of the driving transistor Td during the fourth phase F2. That is to say, the threshold detection module 20 collects the potential (Vsense−|Vth|) to obtain the threshold voltage Vth of the driving transistor Td.

In some embodiments of the present disclosure, as shown in FIG. 6 or FIG. 9, the data voltage writing module 11 is electrically connected to the first electrode of the driving transistor Td, and the method can includes: during the third phase F1, turning on the data voltage writing module 11, and transmitting, by the threshold detection module 20, the detection voltage Vsense to the first electrode of the driving transistor Td through the data voltage writing module 11.

Referring to FIG. 6 or FIG. 9, the input terminal 111 of the data voltage writing module 11 is electrically connected to the first signal line XL1, and the output terminal 112 is electrically connected to the first electrode of the driving transistor Td. In some embodiments, the display apparatus 100 includes a first switch K1, a first terminal of the first switch K1 is electrically connected to the threshold detection module 20, and a second terminal of the first switch K1 is electrically connected to the first signal line XL1. The method can include: during the third phase F1, turning on the first switch K1.

That is to say, during the third phase F1, the threshold detection module 20 transmits the detection voltage Vsense to the first electrode of the driving transistor Td through the turned-on first switch K1 and the data voltage writing module 11.

Referring to FIG. 6 or FIG. 9, the pixel circuit 10 can include a first reset module 15, an input terminal 151 of the first reset module 15 is electrically connected to the second signal line XL2, and an output terminal 152 of the first reset module 15 is electrically connected to the second electrode of the driving transistor Td. The method can include: during the third phase F1, turning on the first reset module 15, and transmitting, by the first reset module 15, the first reset voltage Vref1 to the second electrode of the driving transistor Td.

In some embodiments, the display apparatus 100 includes a fourth switch K4, a first terminal of the fourth switch K4 is electrically connected to the first reset voltage signal line SL1, and a second terminal of the fourth switch K4 is electrically connected to the second signal line XL2. The method can include: during the third phase F1, turning on the fourth switch K4, and transmitting, by the fourth switch K4, the first reset voltage Vref1 to the second signal line XL2.

During the fourth phase F2, the fourth switch K4 is turned off.

That is, during the third phase F1, the first reset voltage Vref1 transmitted by the first reset voltage signal line SL1 is transmitted to the second electrode of the driving transistor Td through the turned-on fourth switch K4 and the first reset module 15. During the fourth phase F2, the fourth switch K4 is turned off, and the second electrode of the driving transistor Td is electrically disconnected from the first reset voltage signal line SL1.

In a first solution, as shown in FIG. 6, the display apparatus 100 includes a third switch K3, a first terminal of the third switch K3 is electrically connected to the threshold detection module 20, and a second terminal of the third switch K3 is electrically connected to the threshold detection module 20. The method can include: during the fourth phase F2, turning on the first reset module 15 and the third switch K3, and collecting, by the threshold detection module 20, the potential of the second electrode of the driving transistor Td through the first reset module 15 and the third switch K3.

In a second solution, as shown in FIG. 9, the display apparatus 100 includes a third switch K3 and a third signal line XL3, and the third signal line XL3 is electrically connected to the second electrode of the driving transistor Td. A first terminal of the third switch K3 is electrically connected to the threshold detection module 20, and a second terminal of the third switch K3 is electrically connected to the third signal line XL3. The method can include: during the fourth phase F2, turning on the third switch K3, turning off the first reset module 15, and collecting, by the threshold detection module 20, the potential of the second electrode of the driving transistor Td through the third switch K3.

In the above two solutions, during the first phase T1 and the second phase T2, the third switch K3 is turned off.

In the technical solutions, during the third phase F1 of the detection phase T0, the threshold detection module 20 transmits the detection voltage Vsense to the first electrode of the driving transistor Td through the turned-on first switch K1 and the data voltage writing module 11; and, at the same time, the first reset voltage Vref1 transmitted by the first reset voltage signal line SL1 is transmitted to the second electrode of the driving transistor Td through the turned-on fourth switch K4 and the first reset module 15. The driving transistor Td is turned on under the control of the potential Vsense of the first electrode of the driving transistor Td and the potential Vref1 of the second electrode of the driving transistor Td, that is, the driving transistor Td is turned on under the control of the potential Vsense of the source of the driving transistor Td and the potential Vref1 of the gate of the driving transistor Td. At the same time, the second transistor M2 electrically connected between the gate and the drain of the driving transistor Td is turned on, and the detection voltage Vsense is transmitted to the second electrode of the driving transistor Td through the turned-on driving transistor Td and the second transistor M2 until the potential of the second electrode of the driving transistor Td is (Vsense−|Vth|), the driving transistor Td is turned off, and the display apparatus 100 begins to enter the fourth phase F2 of the detection phase T0.

During the fourth phase F2 of the detection phase T0, the fourth switch K4 is turned off, the third switch K3 is turned on, and the threshold detection module 20 collects the potential (Vsense−|Vth|) of the second electrode of the driving transistor Td through the turned-on third switch K3 and the first reset module 15, or collects the potential (Vsense−|Vth|) of the second electrode of the driving transistor Td through only the turned-on third switch K3, so as to obtain the threshold voltage Vth of the driving transistor Td.

In some embodiments of the present disclosure, with continued reference to FIG. 6 or FIG. 9, the display apparatus 100 includes a second switch K2, a first terminal of the second switch K2 is electrically connected to the first signal line XL1, and a second terminal of the second switch K2 is electrically connected to the display chip 40. The method can include: during the first phase T1, turning on the second switch K2, and transmitting, by the second switch K2, the data voltage Vdata; during the second phase T2, turning on the second switch K2, and transmitting, by the second switch K2, the adjusting voltage V1; and during the detection phase T0, turning off the second switch K2.

In combination with the above operating process of the pixel circuit 10, it can be learned that during the data writing phase E1, the data voltage Vdata transmitted by the data voltage writing module 11 to the driving transistor Td is the data voltage Vdata transmitted by the second switch K2 during the first phase T1; and during the adjusting phase E3, the adjusting voltage V1 transmitted by the data voltage writing module 11 to the driving transistor Td is the adjusting voltage V1 transmitted by the second switch K2 during the second phase T2.

In some embodiments of the present disclosure, it can be prevented that the data voltage Vdata or the adjusting voltage V1 affects the detection phase T0 of the display apparatus 100 while ensuring that the data voltage Vdata and the adjusting voltage V1 are transmitted to the pixel circuit 10.

Referring to FIG. 6 or FIG. 9, in some embodiments of the present disclosure, the display apparatus 100 includes a fifth switch K5, a first terminal of the fifth switch K5 is electrically connected to a second reset voltage signal line SL2, and a second terminal is electrically connected to the second signal line XL2. The method can include: during the detection phase T0, turning off the fifth switch K5; and during the first phase T1, turning on the fifth switch K5, and transmitting, by the fifth switch K5, the second reset voltage Vref2 to the second signal line XL2.

In some embodiments, the fifth switch K5 can also transmit the second reset voltage Vref2 to the second signal line XL2 during the second phase T2.

Combining with the operating process of the pixel circuit 10, it can be learned that the second reset voltage Vref2 transmitted by the fifth switch K5 can be the reset voltage Vref received by the first reset module 15 during the reset phase E0. The second reset voltage Vref2 can also be the reset voltage Vref transmitted by the second reset module 16 in the pixel circuit 10 to the light-emitting element 30.

In view of the above, during the adjusting phase E3 of the second phase T2, the data voltage writing module 11 transmits the adjusting voltage V1 to the driving transistor Td, so that the bias state of the driving transistor Td can be corrected to reduce the difference between the bias state of the driving transistor Td during the second phase T2 and the bias state of the driving transistor Td during the first phase T1. In this way, the difference in the ramping speed of the current received by the light-emitting element 30 during the first phase T1 and the second phase T2 is reduced, thereby reducing the brightness difference of the display apparatus 100 during the first phase T1 and the second phase T2, and improving the display effect of the display apparatus 100. Since the adjusting voltage V1 transmitted by the data voltage writing module 11 to the driving transistor Td during the adjusting phase E3 corresponds to the threshold voltage Vth of the driving transistor Td, the adjusting voltage V1 received by the driving transistor Td can changes with the characteristic change of the driving transistor Td, and then the difference between the bias states of the driving transistor Td during the second phase T2 and the first phase T1 belonging to a same frame image is minimized, thereby improving the display effect of the display apparatus 100.

The above are merely some embodiments of the present disclosure, which does not limit the present disclosure. Any modification, equivalent substitution, improvement, etc., which are within the principles of the present disclosure, shall fall within the scope of the present disclosure.

What is claimed is:

1. A display apparatus, comprising:

pixel circuits, wherein each of the pixel circuits comprises a driving transistor configured to generate a light-emitting driving current, and a data voltage writing module having an output terminal that is electrically connected to the driving transistor, the data voltage writing module comprises a first transistor;

a fourth switch having a first terminal electrically connected to a first reset voltage signal line, and a second terminal electrically connected to a second signal line; and a threshold detector configured to detect a threshold voltage of the driving transistor of each of the pixel circuits, wherein an operating process of each of the pixel circuits comprises a first phase and a second phase subsequent to the first phase, the first phase comprises a data writing phase and a light-emitting phase subsequent to the data writing phase, and the second phase comprises an adjusting phase and a light-emitting phase subsequent to the adjusting phase;

wherein the data voltage writing module is configured to transmit a data voltage to the driving transistor during the data writing phase, and the data voltage writing module is configured to transmit an adjusting voltage to the driving transistor during the adjusting phase, wherein the adjusting voltage corresponds to the threshold voltage of the driving transistor as detected by the threshold detector;

wherein the display apparatus has detection phases, and the detection phases comprise a third phase and a fourth phase; and wherein during the third phase, the fourth switch is turned on to transmit the first reset voltage to the second signal line, and the fourth switch is turned off during the fourth phase.

2. The display apparatus according to claim 1, further comprising a first region and a second region, wherein among threshold voltages of the driving transistors of the pixel circuits that are detected by the threshold detector, a difference between at least one threshold voltage of the threshold voltages of a part of the driving transistors that are located in the first region and at least one threshold voltage of the threshold voltages of a part of the driving transistors that are located in the second region, is greater than or equal to a first preset value; and wherein an adjusting voltage received by the pixel circuit located in the first region is different from an adjusting voltage received by the pixel circuit located in the second region.

3. The display apparatus according to claim 1, wherein images displayed on the display apparatus comprise a first frame image and a second frame image; a difference between a threshold voltage of the driving transistor detected by the threshold detector during the first frame image and a threshold voltage of the driving transistor detected by the threshold detector during the second frame image is greater than or equal to a second preset value; and an adjusting voltage received by the pixel circuit comprising the driving transistor during the first frame image is different from an adjusting voltage received by the pixel circuit comprising the driving transistor during the second frame image.

4. The display apparatus according to claim 1, wherein the threshold detector is configured to detect the threshold voltage of the driving transistor of each of the pixel circuits during each of the detection phases prior to the first phase.

5. The display apparatus according to claim 4, wherein the threshold detector is configured to transmit a detection voltage to a first electrode of the driving transistor during the third phase, a second electrode of the driving transistor is configured to receive a first reset voltage during the third phase, and the driving transistor is turned on during the third phase; and the driving transistor is turned off during the fourth phase, and the threshold detector is configured to collect a potential of the second electrode of the driving transistor during the fourth phase.

6. The display apparatus according to claim 5, wherein the data voltage writing module is electrically connected to the first electrode of the driving transistor, and the data voltage writing module is turned on during the third phase, and the threshold detector is configured to transmit the detection voltage to the first electrode of the driving transistor through the data voltage writing module during the third phase.

7. The display apparatus according to claim 6, further comprising:

a first switch having a first terminal and a second terminal;

a second switch having a first terminal electrically connected to a first signal line; and a second terminal electrically connected to a display chip;

wherein the data voltage writing module comprises an input terminal electrically connected to the first signal line, and an output terminal is electrically connected to the first electrode of the driving transistor;

the first terminal of the first switch is electrically connected to the threshold detector, the second terminal of the first switch is electrically connected to the first signal line, and the first switch is turned on during the third phase; and the second switch is turned on to transmit the data voltage during the first phase, the second switch is turned on to transmit the regulation voltage during the second phase, and the second switch is turned off during the detection phase.

8. The display apparatus according to claim 5, further comprising:

a third switch, wherein the third switch has a first terminal electrically connected to the threshold detector, and a second terminal electrically connected the second signal lines;

wherein each of the pixel circuits further comprises a first reset module, wherein the first reset module comprises an input terminal electrically connected to a second signal line, and an output terminal electrically connected to the second electrode of the driving transistor; and the first reset module is turned on to transmit a first reset voltage to the second electrode of the driving transistor during the third phase; and wherein during the fourth phase, the first reset module and the third switch are turned on, and the threshold detector is configured to collect the potential of the second electrode of the driving transistor through the first reset module and the third switch.

9. The display apparatus according to claim 8, further comprising:

a fifth switch having a first terminal electrically connected to a second reset voltage signal line, and a second terminal electrically connected to the second signal line;

wherein the fifth switch is turned off during the detection phases, and the fifth switch is configured to transmit a second reset voltage to the second signal line during the first phase.

10. The display apparatus according to claim 8, further comprising:

the third switch having a first terminal and a second terminal; and a third signal line electrically connected to the second electrode of the driving transistor, wherein the first terminal of the third switch is electrically connected to the threshold detector, and the second terminal of the third switch is electrically connected to the third signal line;

wherein the third switch is turned on during the fourth phase, and the first reset module is turned off during the fourth phase; and the threshold detector is configured to collect the potential of the second electrode of the driving transistor through the third switch during the fourth phase; and wherein the third switch is turned off during the first phase and the second phase.

11. A method for driving a display apparatus, the display apparatus comprising:

pixel circuits, wherein each of the pixel circuits comprises a driving transistor configured to generate a light-emitting driving current, and a data voltage writing module having an output terminal that is electrically connected to the driving transistor, the data voltage writing module comprises a first transistor;

a fourth switch having a first terminal electrically connected to a first reset voltage signal line, and a second terminal electrically connected to a second signal line; and a threshold detector configured to detect a threshold voltage of the driving transistor of each of the pixel circuits, wherein an operating process of each of the pixel circuits comprises a first phase and a second phase subsequent to the first phase, the first phase comprises a data writing phase and a light-emitting phase subsequent to the data writing phase, and the second phase comprises an adjusting phase and a light-emitting phase subsequent to the adjusting phase;

wherein the data voltage writing module is configured to transmit a data voltage to the driving transistor during the data writing phase, and the data voltage writing module is configured to transmit an adjusting voltage to the driving transistor during the adjusting phase, wherein the adjusting voltage corresponds to the threshold voltage of the driving transistor detected by the threshold detector; and wherein the display apparatus has detection phases, and the detection phases comprise a third phase and a fourth phase;

the method comprising:

transmitting, by the data voltage writing module, the data voltage to the driving transistor during the data writing phase; and transmitting, by the data voltage writing module, the adjusting voltage corresponding to the threshold voltage of the driving transistor to the driving transistor during the adjusting phase;

during the third phase, turning on the fourth switch, and transmitting, by the fourth switch, the first reset voltage to the second signal line; and during the fourth phase, turning off the fourth switch.

12. The method according to claim 11, wherein the detection phases are performed by each of the pixel circuits prior to the first phase; and the method further comprises:

detecting, by the threshold detector, the threshold voltage of the driving transistor of each of the pixel circuits during the detection phases.

13. The method according to claim 12, wherein the detecting, by the threshold detector, the threshold voltage of the driving transistor of each of the pixel circuits, comprises:

during the third phase, transmitting, by the threshold detector, the detection voltage to a first electrode of the driving transistor, receiving, by the second electrode of the driving transistor, a first reset voltage, and turning on the driving transistor;

during the fourth phase, stop receiving, by the driving transistor, the first reset voltage, turning off the driving transistor, and collecting, by the threshold detector, a potential of the second electrode of the driving transistor;

wherein the data voltage writing module is electrically connected to the first electrode of the driving transistor; and wherein the method further comprises:

during the third phase, turning on the data voltage writing module, and transmitting, by the threshold detector, the detection voltage to the first electrode of the driving transistor through the data voltage writing module.

14. The method according to claim 13, wherein the data voltage writing module comprises an input terminal electrically connected to a first signal line, and an output terminal electrically connected to the first electrode of the driving transistor; and the display apparatus further comprises a first switch having a first terminal electrically connected to the threshold detector, and a second terminal electrically connected to the first signal line; and the method further comprises:

during the third phase, turning on the first switch.

15. The method according to claim 14, wherein the display apparatus further comprises a second switch having a first terminal electrically connected to the first signal line, and a second terminal electrically connected to a display chip; and the method further comprises:

during the first phase, turning on the second switch, and transmitting, by the second switch, the data voltage;

during the second phase, turning on the second switch, and transmitting, by the second switch, the adjusting voltage; and during the detection phase, turning off the second switch.

16. The method according to claim 13, wherein each of the pixel circuits further comprises a first reset module, wherein the first reset module comprises an input terminal electrically connected to the second signal line, and an output terminal electrically connected to the second electrode of the driving transistor; and the method further comprises:

during the third phase, turning on the first reset module, and transmitting the first reset voltage to the second electrode of the driving transistor.

17. The method according to claim 16, wherein the display apparatus further comprises a third switch having a first terminal electrically connected to the threshold detector, and a second terminal electrically connected to the second signal line; and the method further comprises:

during the fourth phase, turning on the first reset module and the third switch, and collecting, by the threshold detector, the potential of the second electrode of the driving transistor through the first reset module and the third switch.

18. The method according to claim 16, wherein the display apparatus further comprises a third switch having a first terminal and a second terminal, and a third signal line, wherein the third signal line is electrically connected to the second electrode of the driving transistor; the first terminal of the third switch is electrically connected to the threshold detector, and the second terminal of the third switch is electrically connected to a third signal line; and the method further comprises:

during the fourth phase, turning on the third switch, turning off the first reset module, and collecting, by the threshold detector, the potential of the second electrode of the driving transistor through the third switch;

wherein the third switch is turned off during the first phase and the second phase.

19. The method according to claim 11, wherein the display apparatus further comprises a fifth switch having a first terminal electrically connected to a second reset voltage signal line, and a second terminal electrically connected to the second signal line; and the method further comprises:

during the detection phase, turning off the fifth switch; and during the first phase, turning on the fifth switch, and transmitting, by the fifth switch, a second reset voltage to the second signal line.

* * * * *